US006598703B1

(12) United States Patent
Catalan

(10) Patent No.: US 6,598,703 B1
(45) Date of Patent: Jul. 29, 2003

(54) EXTERNALLY CONCEALABLE, MODULAR HIGH-RISE EMERGENCY EVACUATION APPARATUS WITH PRE-QUALIFIED EGRESS

(76) Inventor: Roberto Sanchez Catalan, 30 Matulungin St., Central District, Diliman, Quezon City 1100 (PH)

( * ) Notice: Subject to any disclaimer, the term of this patent is extended or adjusted under 35 U.S.C. 154(b) by 0 days.

(21) Appl. No.: 10/152,195

(22) Filed: May 21, 2002

(51) Int. Cl.[7] ..... A62B 1/20

(52) U.S. Cl. ..... 182/48; 182/49; 182/71; 187/414

(58) Field of Search ..... 182/48, 49, 71, 182/76, 138; 187/414

(56) References Cited

U.S. PATENT DOCUMENTS

| | | | | | |
|---|---|---|---|---|---|
| 3,348,630 | A | | 10/1967 | Yamamoto | 182/48 |
| 3,973,644 | A | | 8/1976 | Zephinie | 182/47 |
| 3,977,495 | A | * | 8/1976 | Zephinie | 182/48 |
| 4,099,595 | A | | 7/1978 | Tracy | 182/48 |
| 4,099,596 | A | | 7/1978 | Tracy | 182/48 |
| 4,122,934 | A | * | 10/1978 | Nieto De MOreno | 193/32 |
| 4,162,717 | A | * | 7/1979 | Orii et al. | 182/48 |
| 4,167,224 | A | * | 9/1979 | Kinase et al. | 182/48 |
| 4,240,520 | A | * | 12/1980 | LaGrone et al. | 182/48 |
| 4,595,074 | A | * | 6/1986 | Nordvedt | 182/48 |
| 4,605,095 | A | * | 8/1986 | Koizumi | 182/48 |
| 4,681,186 | A | * | 7/1987 | Leisman et al. | 182/47 |
| 4,778,031 | A | | 10/1988 | Curiel | 182/48 |
| 4,997,060 | A | * | 3/1991 | Sassak | 182/48 |
| 5,320,195 | A | | 6/1994 | Reece et al. | 182/48 |
| 5,562,184 | A | * | 10/1996 | Yung-Ho | 187/414 |
| 5,620,058 | A | | 4/1997 | Forrester | 182/48 |
| 5,806,624 | A | | 9/1998 | Nordtvedt | 182/48 |
| 5,871,066 | A | | 2/1999 | Reece | 182/48 |
| 6,098,747 | A | | 8/2000 | Reece | 182/48 |
| 6,102,762 | A | * | 8/2000 | Bell et al. | 441/80 |
| 6,467,575 | B1 | * | 10/2002 | Chen | 182/48 |

* cited by examiner

*Primary Examiner*—Bruce A. Lev

(57) ABSTRACT

An externally concealable modular high-rise emergency evacuation apparatus that enables people, including the injured, the elder or drabled persons to escape entrapment from or to bypass the levels of a high-rise building that is impassable due to flame, smoke or heavy damage, with very little effort or assistance, comprising a slanted cylindrical booth with a trap door bottom, elongated poles with trusses, expandable reinforced descent tubes with fire-proof skin, stabilizer webbings, an inflatable slide, and active components comprised of sensors, switches, latches and relays that coordinates, prequalifies and controls access then egress through the apparatus, with emphasis on checking the integrity of a complete escape path and approximating free space for each evacuee within said descent tubes, thereby enhancing supported evacuee volume and safety.

2 Claims, 33 Drawing Sheets

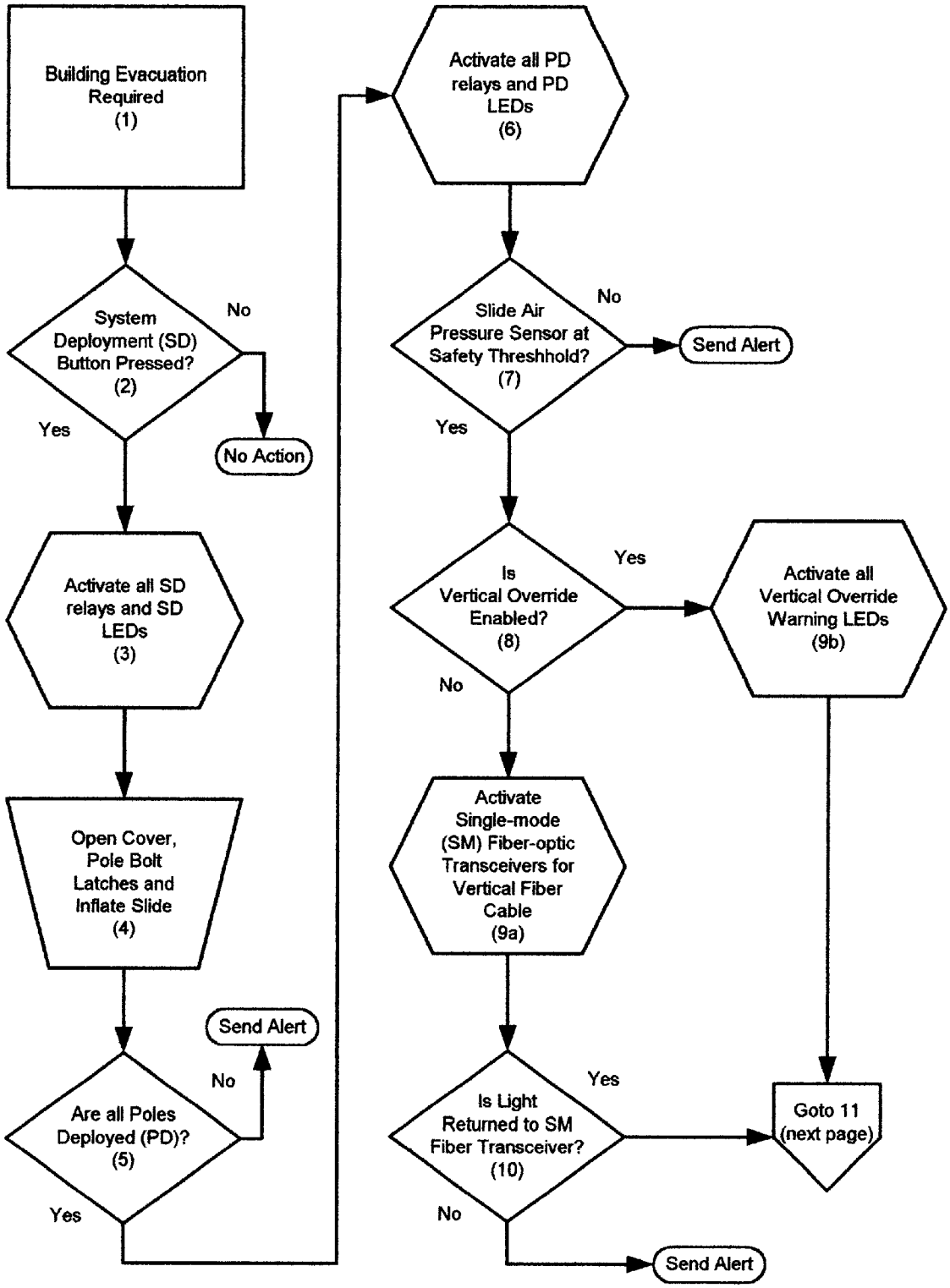
FIG. 10A (page 1 of 3)

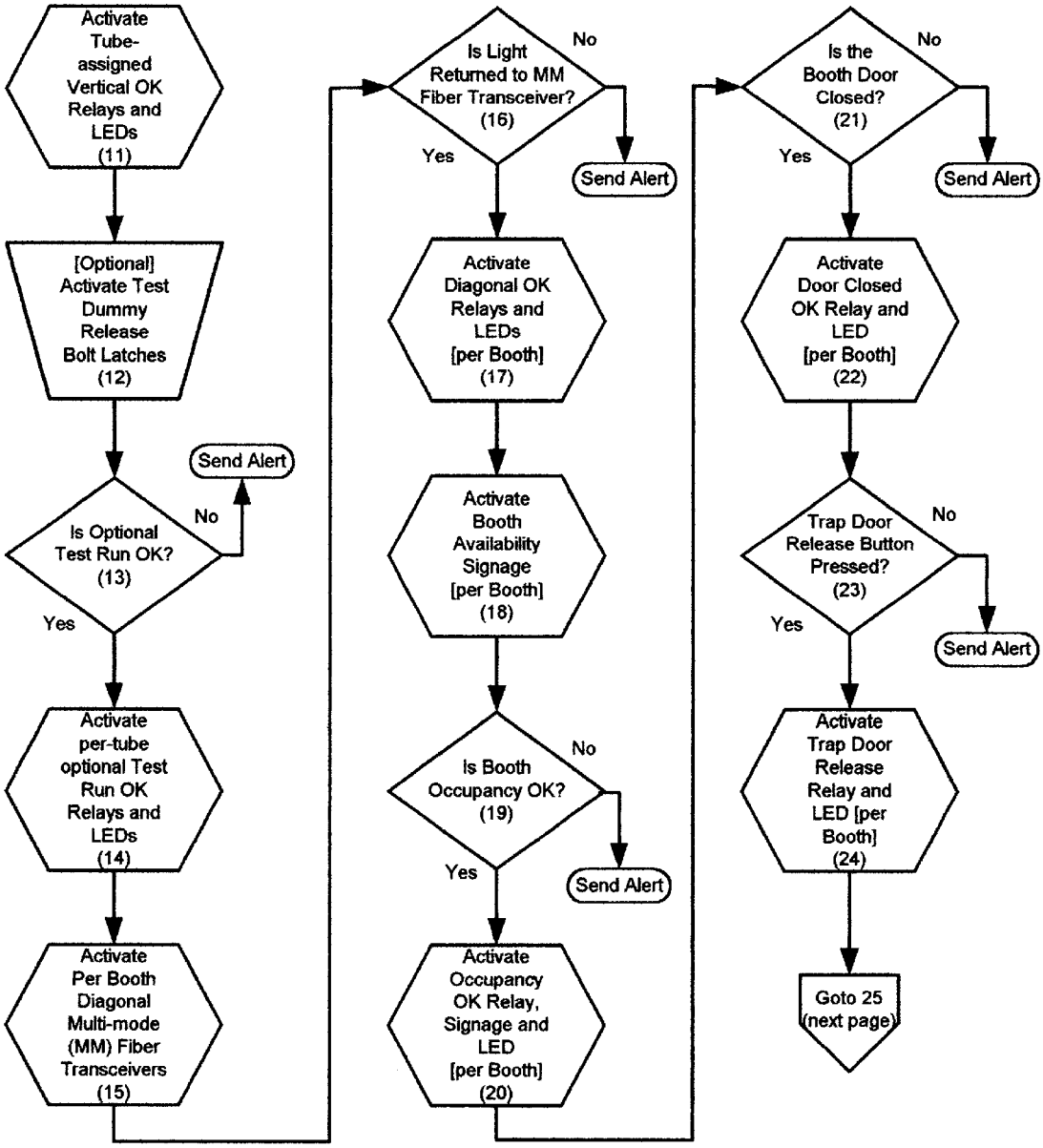
FIG. 10A (page 2 of 3)

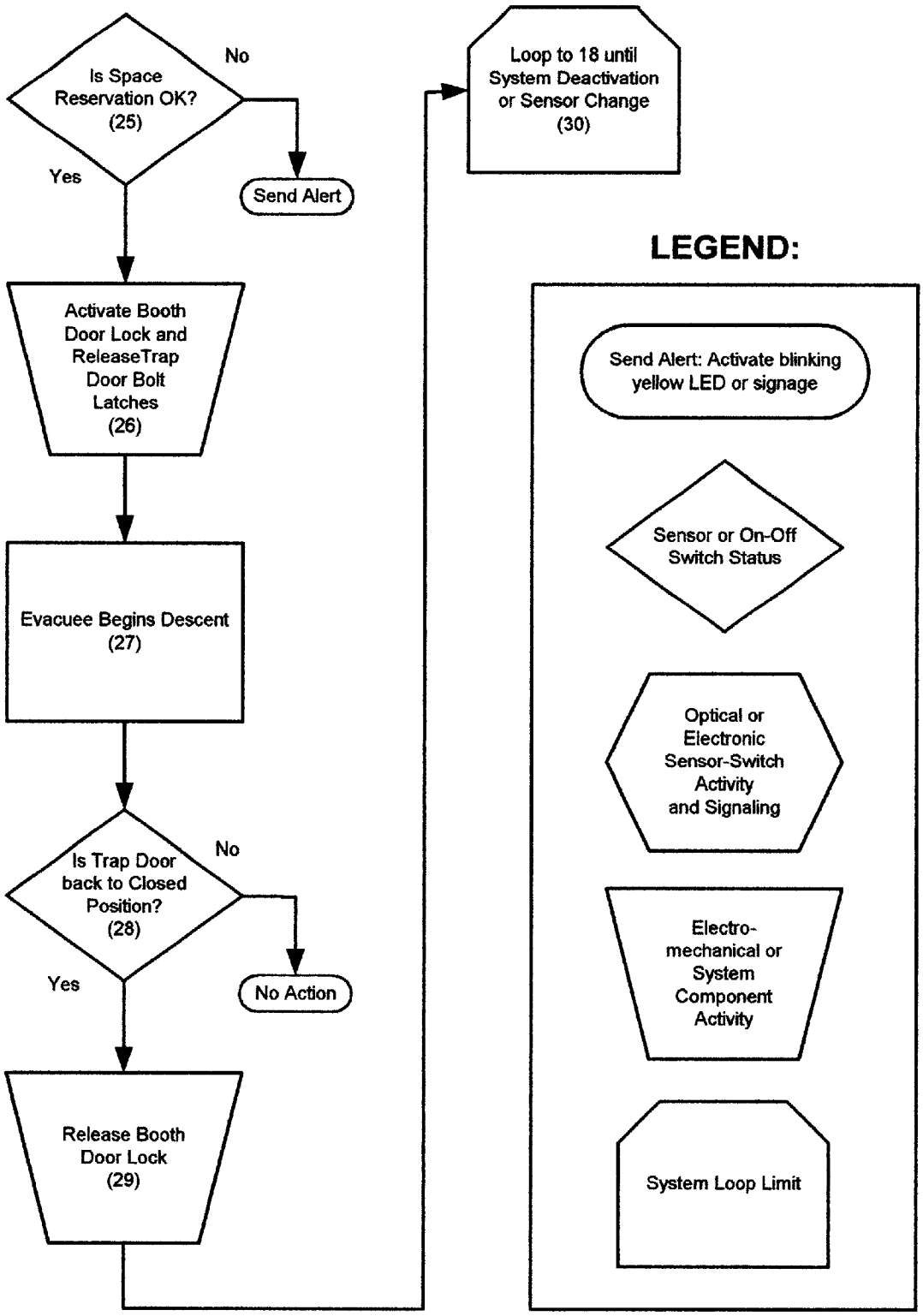
FIG. 10A (page 3 of 3)

EXTERNALLY CONCEALABLE, MODULAR HIGH-RISE EMERGENCY EVACUATION APPARATUS WITH PRE-QUALIFIED EGRESS

BACKGROUND

1. Field of Invention

This invention relates to an apparatus for the emergency evacuation of people from high-rise buildings during fires, earthquakes, terrorist attacks and other disasters. The horrific events of Sep. 11, 2001 at the World Trade Center (WTC) surpassed all previous high-rise tragedies in terms of destruction and loss of life. The excessive amount of time and effort required to go down accessible emergency stairwells of the WTC carried severe consequences. Moreover, the global media coverage that televised trapped individuals jumping from the WTC towers tortuously renewed a long felt, long existing and still unsolved need. That need is for a quick, efficient, relatively inexpensive, practical, reliable and safe means of enabling even elderly, injured or disabled persons to either escape entrapment from or to bypass the levels of a high-rise building that is impassable due to flame, smoke or heavy damage with very little effort or assistance.

2. Description of Prior Art

There are known numerous devices used on aircraft, sea vessels and buildings for emergency evacuations to prevent or minimize injury or death resulting from fire, earthquakes, crashes, terrorism or other tragic events.

U.S. Pat. No. 3,973,644 discloses a chute and lowering device that is excessively complicated and lacking in versatility to easily support the swift evacuation of a great number of people.

U.S. Pat. Nos. 3,348,630, 4,099,595 and 4,099,596 disclose chutes as emergency evacuation devices. Disclosed are chute systems where the rate of deceleration of vertical drop is achieved by applying local braking elements that lessen the rate of descent by a person using the same. The rate of descent is fast and sudden between braking elements. Under very stressful circumstances a person, even with prior training on the device, cannot be reasonably expected to consistently employ these local braking elements correctly without sustaining injury.

U.S. Pat. No. 4,778,031 discloses a device that has an outer heat shield and an inner chute for controlled descent. However, individuals of various sizes are not easily supported, as the expansion is limited to an expansion joint. The overall design detracts from a building's aesthetics.

U.S. Pat. No. 5,320,195 discloses an emergency chute that uses bands of Spandex to provide a controlled rate of descent via elastic properties of the material. Generally however, it has similar disadvantages as those in U.S. Pat. No. 4,778,031.

U.S. Pat. No. 5,871,066 discloses a frame for an escape chute that does not take into account the panic that may be expected during emergency situations. Individuals may inadvertently push others beyond the frame into free fall. The frame's ledgebased design does not allow easy initial access for injured, disabled, elderly or unconscious individuals. Moreover, if used in multistory structures, the frame's placement fails to consider fear of heights and overestimates the capacity of ordinary individuals to undertake the physical act of going over a safe ledge from an extreme altitude. Finally, the frame is in very close proximity to the building. Thus, evacuees are still dangerously close to fire and smoke. If the frame is attached onto a ledge that is of flammable material, the frame may break free and plummet to the ground, and possibly hit people below.

U.S. Pat. No. 6,098,747 discloses a single chute which is knit-weaved, that combines thermal material such as Treveria FR (™) or a polyamide such as Kevlar (™) and an elastic material such as Spandex (™). It erroneously assumes that the combination of the thermal and elastic qualities of these two materials into a single knitwoven fabric can transfer each material's characteristics to the other. The dangerous consequences of this incorrect assumption have significantly influenced the design of the present invention. The following detailed elaborations are deemed essential:

The vertical Kevlar (™) component of the knit woven material is not likely to acquire the elasticity of the horizontal Spandex (™) component. Since the application of the rescue chute calls for the knit woven fabric to be wrapped, clamped and fastened around a frame and that the weight of several individuals must be supported by the same knit woven fabric, a risk factor must be pointed out, that is, the Kevlar (™) component of the rescue chute can suddenly snap or break.

The assertion as to the fragility of Kevlar when specifically applied in U.S. Pat. No. 6,098,747 rescue chute, is supported by knowledgeable individuals who have reported their findings through several websites. A hang gliding website's preflight inspection webpage clearly states: http://www.bigairparagliding.com/Tipsdetall.cfm?Title=Glider%20Inspections "If your glider has Keviar lines, you can expect to replace them periodically. The reason for this is that Kevlar has "memory", or is "knot sensitive". This means that weak points develop where the line has been looped, tied, bent, or knotted for any reason."

Again, a webpage discussing Kevlar's lack of elasticity and resulting weakness is cited in a motorcyclist's apparel website. It is mentioned that:

> http://www.aerostich.com/isroot/riderwearhouse/DirectPages/straightstory.htmls ". . . believe it or not, pure Kevlar® fabric actually is much less abrasion-resistant than Cordura nylon. Kevlar® fibers have far less elasticity than Cordura® nylon fibers, a crucial handicap in a crash. Even the smoothest pavements have a rough aggregate surface that causes abrasive pulling. Nylon's stretchy fibers will elongate, ride over the surface irregularities, then snap back into the weave (like a tree bending in a strong wind), but Keviar® fibers quickly reach their tensile limit and snap."

Another webpage clearly mentioning Kevlar's tendency to break suddenly may be found at the following archery enthusiast's website. It is mentioned that:

> http://www.alansarchery.pwp.blueyonder.co.uk/Equipment/Strings/Strings.htm "These LCP's were important in their day, especially Kevlar. They still have important uses outside of archery, but have been replaced for our purposes by newer, more reliable fibres. There are still plenty of spools of Keviar and other aramids knocking around in cupboards and tackle boxes, but they should not be used. Even when new they have a short life—often as low as 1000 shots—and tendency to break without warning. After a few years storage, especially in sunlight, they could be positively dangerous."

The horizontal Spandex (™) component of the knitwoven material will not suddenly gain the fire-resistant qualities of the vertical Kevlar (™) component. The knit-woven material will be progressively consumed by flame. The motorcyclist's apparel website at the following webpage explains this statement saying that:

http:/Iwww.aerostich.com/isroot/riderwearhouse/DirectPages/straightstory.html "To solve these problems, manufacturers blend Kevlar® with Lycra® and nylon. In this blend, "Kevlar®" is only about one third actual Kevlar®. This creates problems. Because of the additional nylon and Lycra®, much of its slight weight advantage over Cordura® is lost. It also loses some of its fireresistant qualities. The blended Kevlar® fabric may bum or melt Oust like nylon) when it comes in contact with a flame, hot component, or high frictional heat."

As designed, the rescue chute of U.S. Pat. No. 6,098,747 can only be accessed where the frame is located and limited only to one story at a time. In case another evacuee needed to deploy another rescue chute immediately below the first one, it would not be possible. To increase the number of evacuees across several stories therefore, horizontal deployment of several rescue chutes of varying lengths would be required, but this can be a severe limitation during emergencies. Furthermore, no attempt is made to properly space evacuees apart, to prevent bodily contact, or to avoid collisions from occurring when several evacuees travel down the rescue chute.

Finally and more importantly, should the fire be at a lower level than the evacuee and the lower portion of the rescue chute is damaged, there is no way to ascertain the serviceability of the fabric before descending down the rescue chute. This feature of the rescue chute should be a serious consideration, due to the very nature of its intended use.

After the tragic events of Sep. 11, 2001, there has been a call for emergency elevator systems to be implemented in all high-rise buildings. Specifically these emergency elevators must have superior reinforcements to withstand bomb blasts, dedicated ventilation, standalone electrical power systems and independent communications systems for each elevator shaft. Naturally, most building owners and administrators have deemed these requirements as expensive and impractical to implement.

OBJECTS AND ADVANTAGES

Several objects and advantages of the present invention are:

(a) to provide expeditious and safe evacuations from a high-rise building during emergencies by implementing an apparatus that checks its own physical integrity and approximates free space for each evacuee, thereby allowing pre-qualified egress through the system;

(b) to provide a high-rise emergency evacuation system that is easy to use during emergency situations even by people who are totally uninitiated about its use, and by whose who may be acrophobic or who are afraid of heights;

(c) to provide a high-rise emergency evacuation system that is relatively inexpensive, uncomplicated to integrate into existing high-rise buildings, and externally concealable so as to preserve the building's external aesthetics, structural integrity and valuable real estate;

(d) to provide a permanently-affixed, independent and readily-available high-rise emergency evacuation system that aims to revive confidence in high-rise tenancy specially after Sep. 11, 2001 by ensuring a swifter, less-strenuous and safe evacuation alternative that can significantly reduce normal feelings of anxiety generated by an awareness that the staircase is the only emergency exit option for an individual who goes out of an elevator at a height of perhaps twenty-five or more stories, and reads a sign that says "Do not use the elevator during fire or earthquakes.";

(e) to provide a high-rise emergency evacuation system that requires only a minimal amount of power to be immediately operational but which can enable a high volume of evacuees to egress during emergencies, especially when swift evacuations en masse is necessary from high-rise buildings;

(f) to provide a high-rise emergency evacuation system that is modular, rendering it less expensive to manufacture and resulting in an increase in the overall strength of the materials used, as the weight and stresses throughout the apparatus would be distributed;

(g) to provide a high-rise emergency evacuation system that can allow even injured, elderly and disabled individuals to evacuate a building with minimum effort or assistance. Likewise, unconscious individuals may either be accompanied or strapped onto special self-inflating stretchers and evacuated from a high-rise building with relative ease;

(h) to provide a high-rise emergency evacuation system that can protect evacuees from fire, smoke, chemicals, fuel, falling objects, and the like, by transporting them immediately away from the building premises through a system of high-tensile strength long poles attached to the building's superstructure and an appropriate combination of advanced fire-resistant fabrics and specialized composite materials; and (i) to provide a high-rise emergency evacuation system that does not compromise building security by effectively preventing unauthorized access into the building through the system, while allowing quick and efficient emergency egress out of the building when required.

Further objects and advantages shall become more apparent after considering the ensuing descriptions and drawings.

SUMMARY

The present invention solves a long felt, long existing need for a quick, efficient, relatively inexpensive, practical, reliable and safe way of enabling even elderly, injured or disabled persons to escape entrapment from or to bypass the levels of a skyscraper or high-rise building that is impassable due to flame, smoke or heavy damage with very little effort or assistance, by using an apparatus that checks its own physical integrity and approximates free space for each evacuee thereby allowing pre-qualified egress through the system.

Unlike prior art, the present invention allows the apparatus to be concealed, despite being a permanent fixture of the building itself. The present invention, as a new and unusual result, enables appropriate spacing between several evacuees who are utilizing a single descent tube, despite the fact that the said evacuees may originate from different stories of the same building.

Human stampede, even at ground level can be deadly. At any extreme height or extreme depth, safe travel requires a measure of discipline and control. A high-rise evacuation system then must ensure swift but orderly escape. The present invention's unique combination of the cylindrical door, door sensors, including the dimensions and slant of the egress booth, induce the required discipline and control to ensure that only an allowable number of evacuees are in the egress booth when the trap door opens.

There is a common saying that: 'You can immediately tell how strong a rope is by deciding if you are willing to risk your life using it'. The same idea applies to prior art, wherein a single fabric is commonly used to transport several evacuees in vertical descent. This single fabric used in prior art is designed for horizontal elasticity and vertical strength. True to form, very few people are willing to risk their lives by using these prior art fabrics, most specially if great heights and the weight of several people are involved. The present invention addresses this issue through a novel combination of appropriate materials in a unique form, thereby ensuring that each element's individual characteristics that made it desirable for the task, is never compromised or diluted. Furthermore, its modular design, as a new and unexpected result, increases the overall strength of the materials used in the present invention as the weight and stresses are distributed throughout the apparatus.

DRAWINGS

Drawing Figures

In the drawings, closely related figures have the same number but different alphabetic suffixes.

Figure 4A:
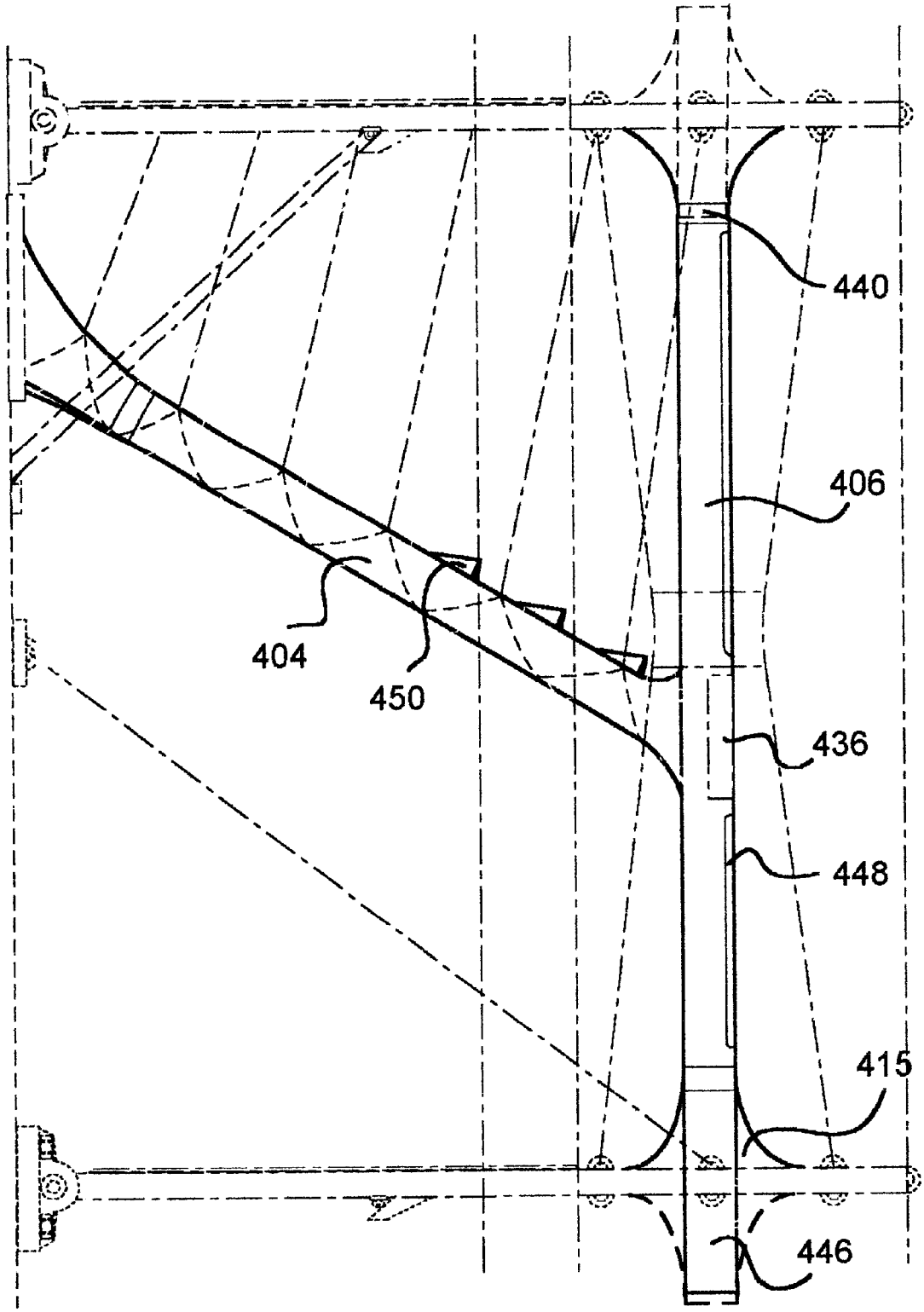
FIG. 4A shows a side view of the building with focus on a y-shaped modular descent tube.
Figure 4B:
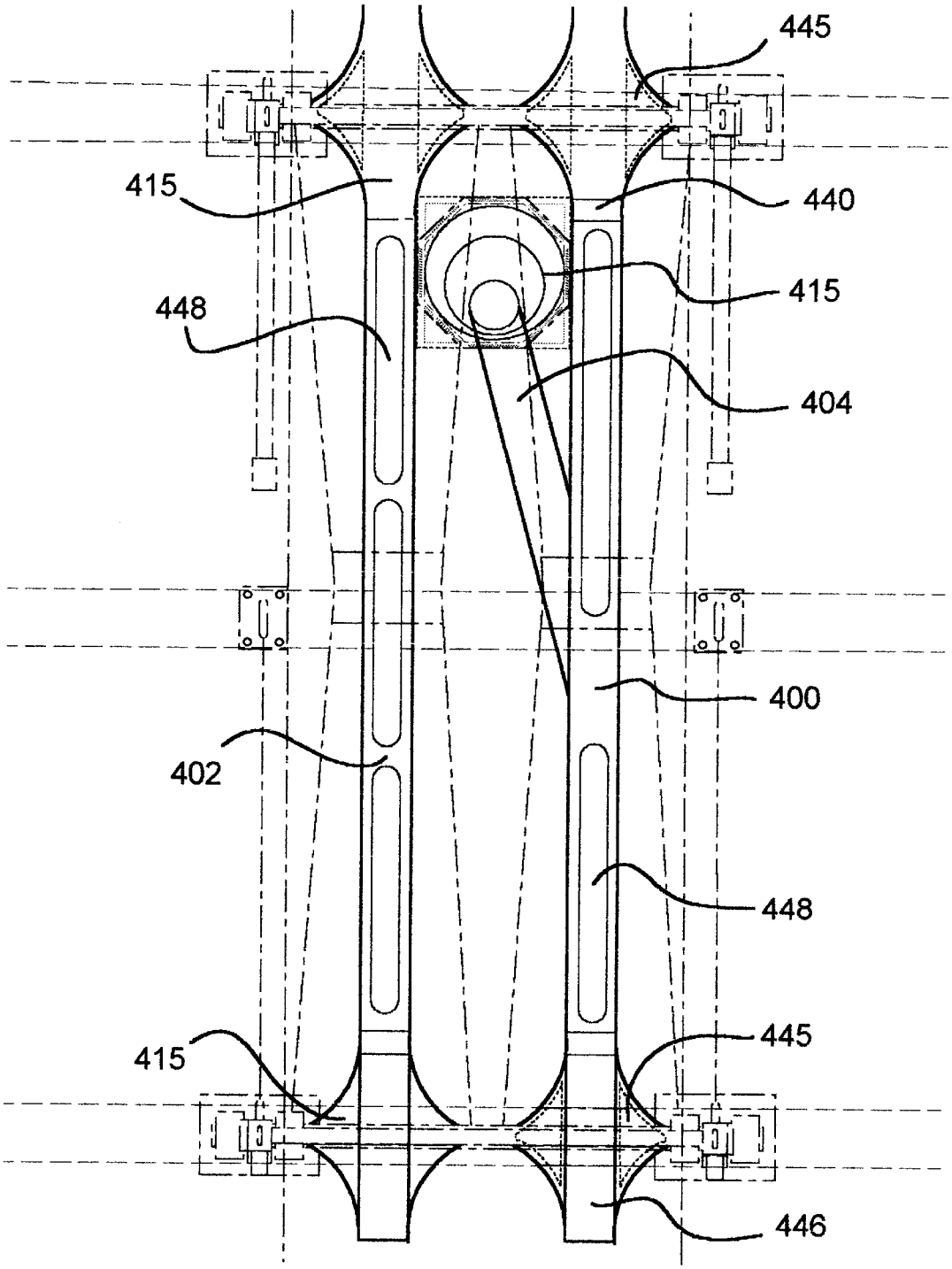
FIG. 4B shows a front view of the modular descent tubes to facilitate the understanding of how greater evacuee volume is supported by two descent tubes and to show the positioning of the ventilation holes.
Figure 4C:
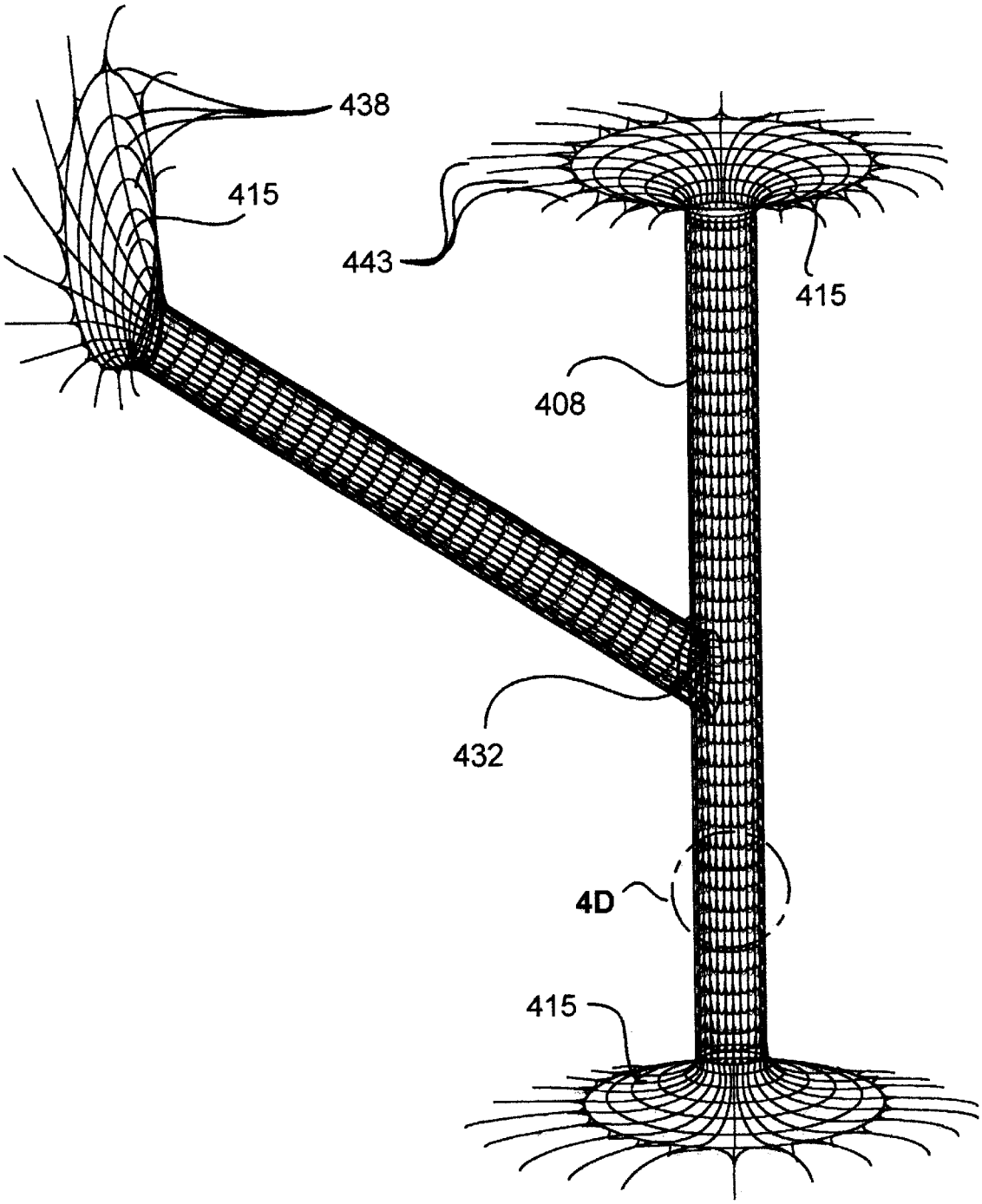
FIG. 4C shows a perspective view a single-piece cargo netting that serves as an internal backbone component of the y-shaped modular descent tube.
Figure 4D:
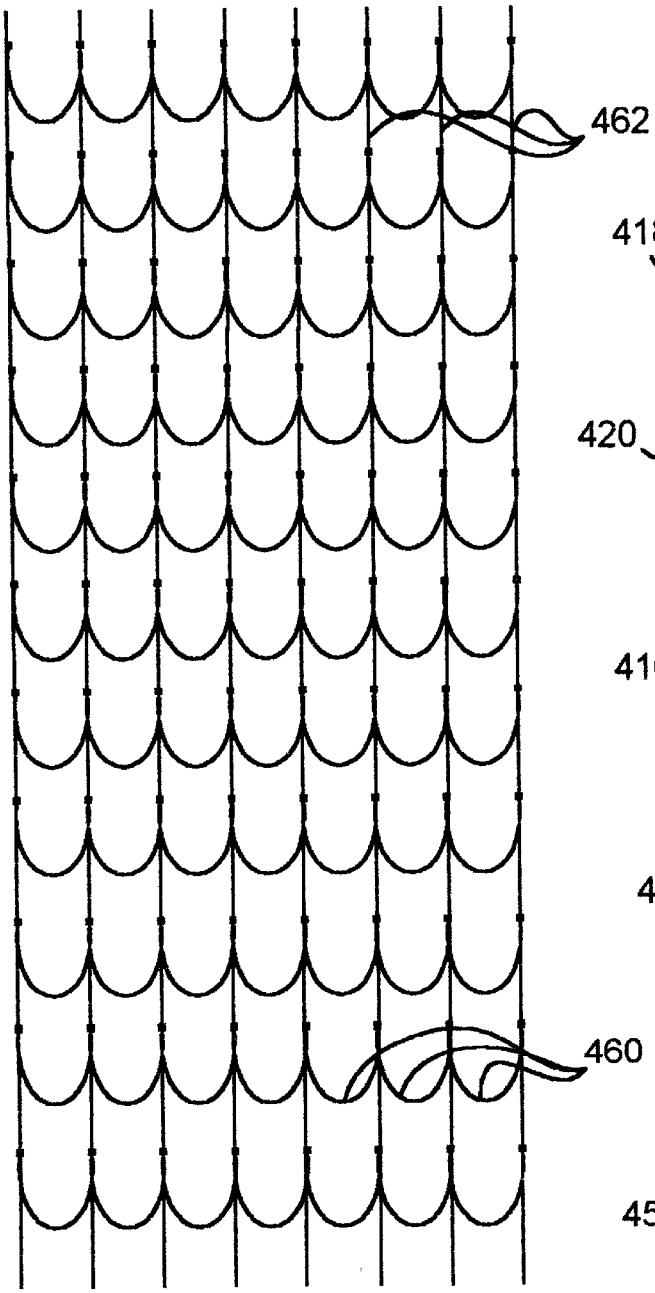
FIG. 4D shows a detailed front view of the state of the single-piece cargo netting prior to its cladding with breathable elastic material, thus allowing the netting to expand as required.
Figure 4E:
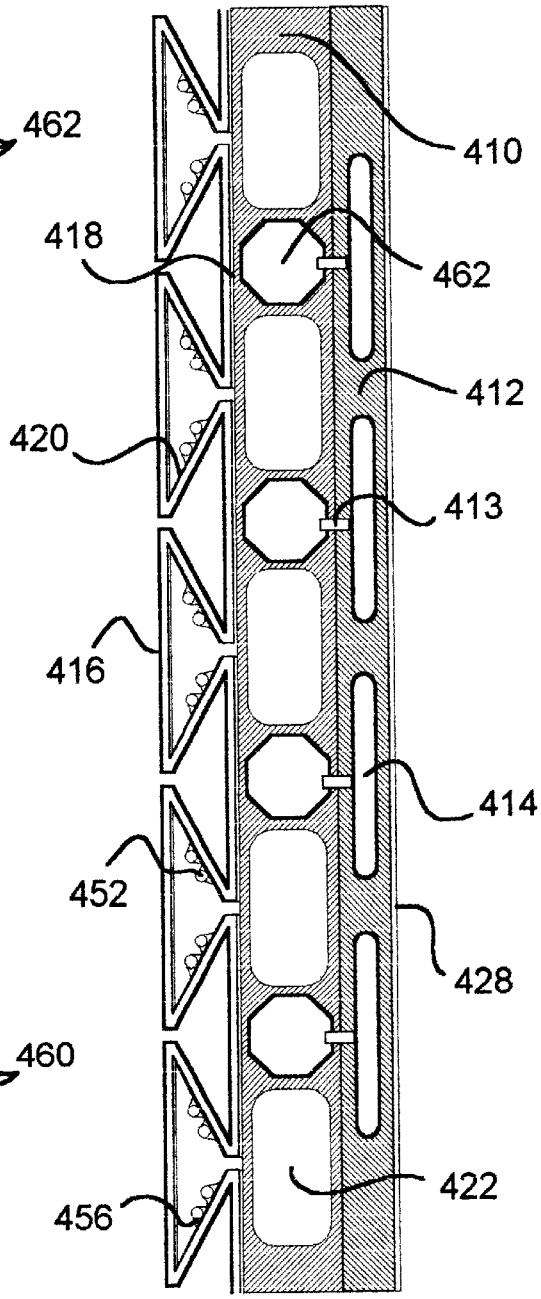
FIG. 4E shows a detailed top view of special materials that make up the modular descent tube, with focus on fabric sensors.
Figure 4F:
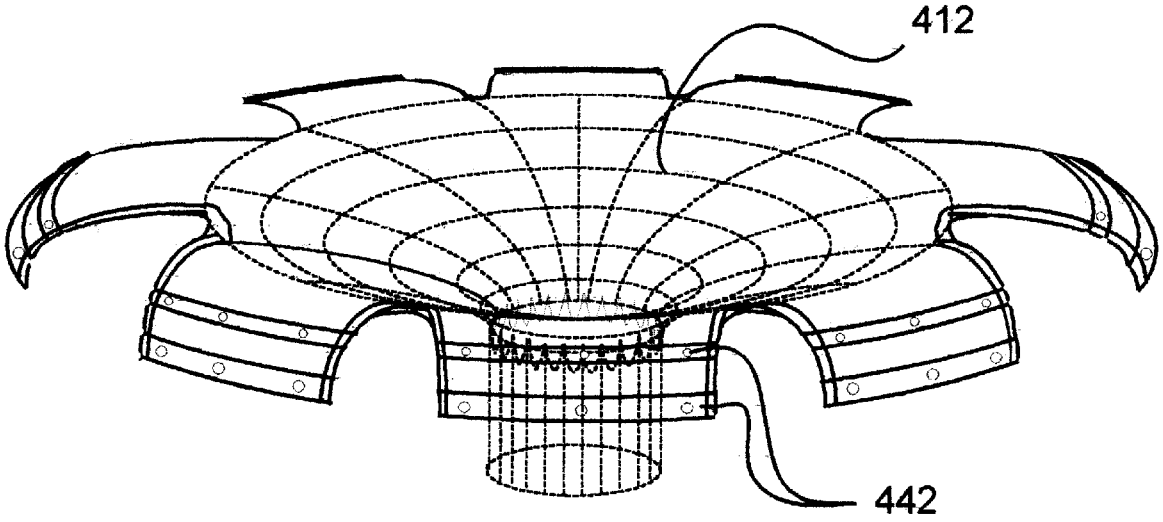
FIG. 4F shows a perspective view of a funnel-shaped reinforced elastic material that serves as an innermost layer for the modular descent tube and an attachment means to the pole trusses.
Figure 4G:
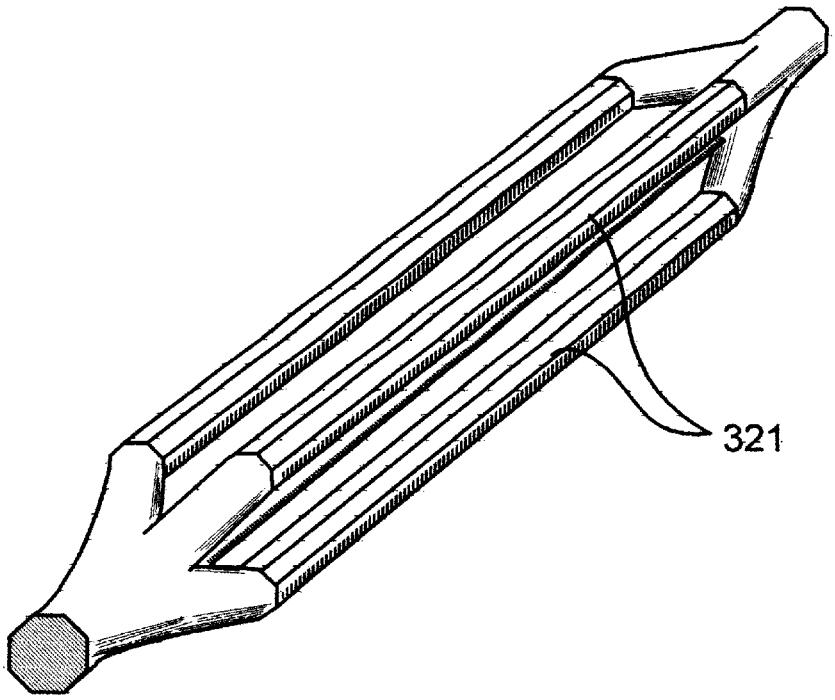
FIG. 4G shows a perspective view of a typical side of an octagonal truss, generally designed as four bars branching out from a center bar.
Figure 4H:
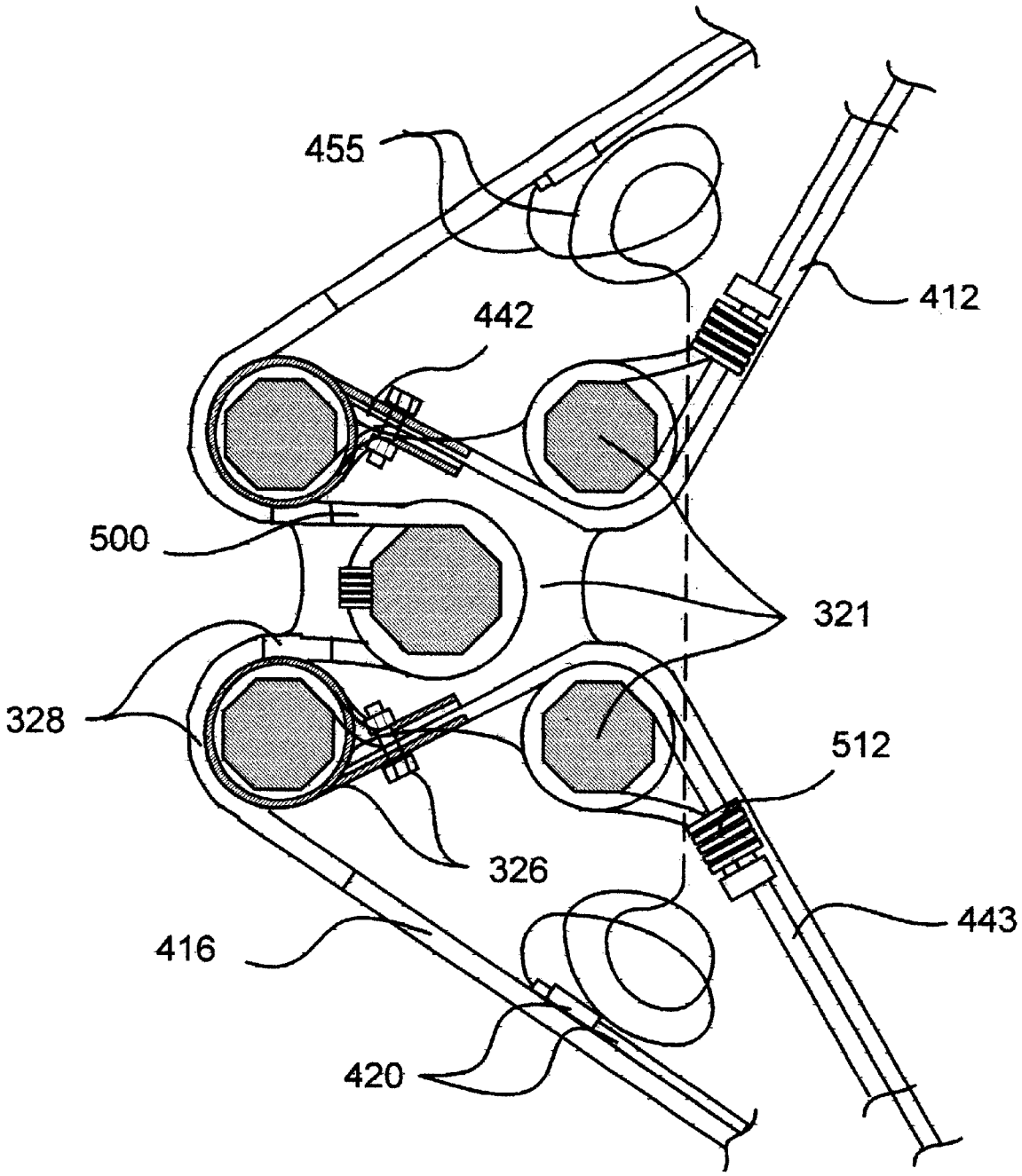
FIG. 4H shows a side cutaway view of FIG. 4G, and its unique design that facilitates the attachment of three main materials that comprise the modular descent tube.
Figure 4I:
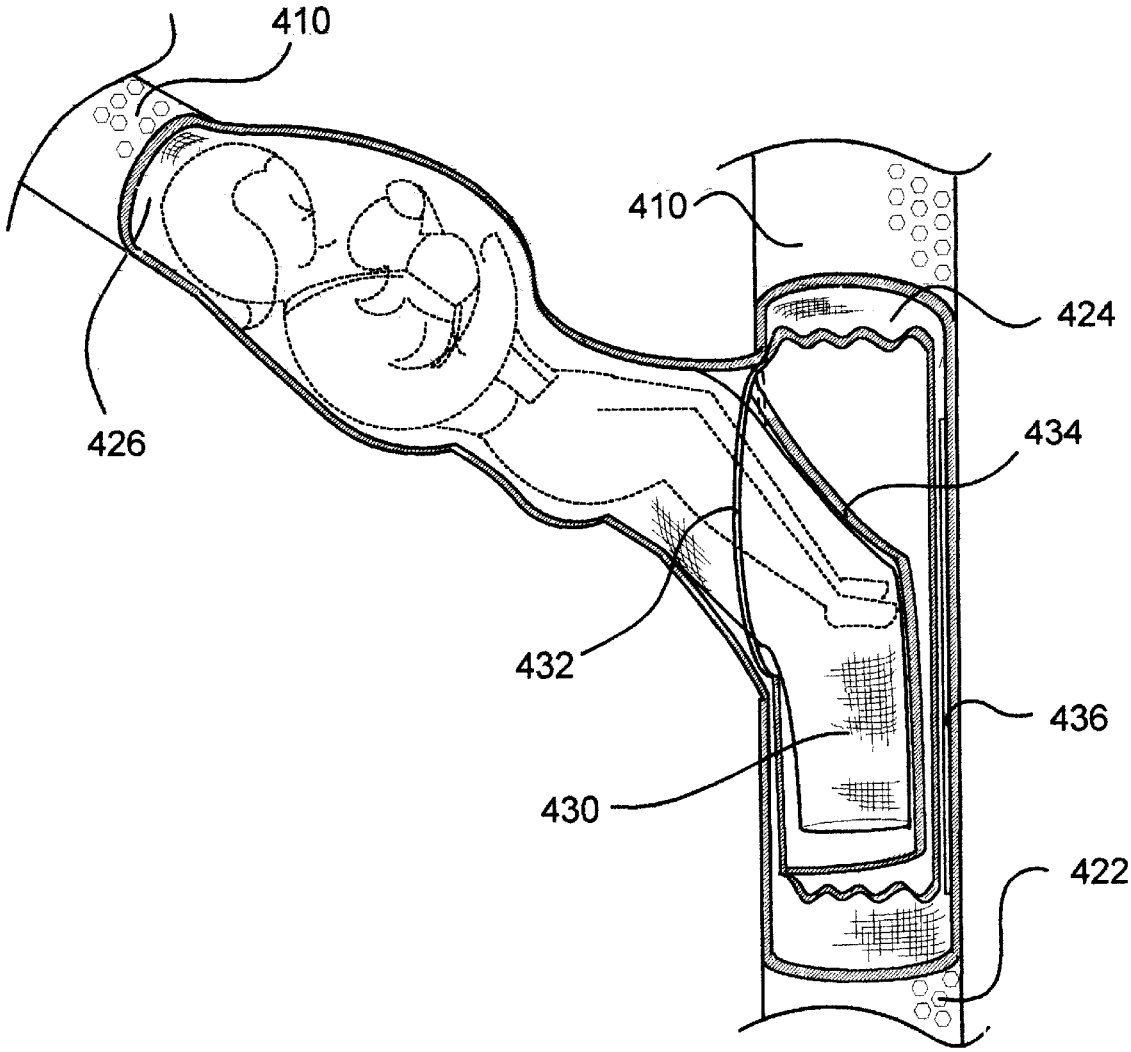
FIG. 4I shows a perspective, cross-sectional view of the descent tube material, sans fire-proof layer for clarity, with an evacuee with child in a recommended harness, in the diagonal section of a y-shaped modular descent tube immediately prior to transition to vertical descent, with particular focus on how the descent tubes are designed to facilitate the transition.
Figure 4J:
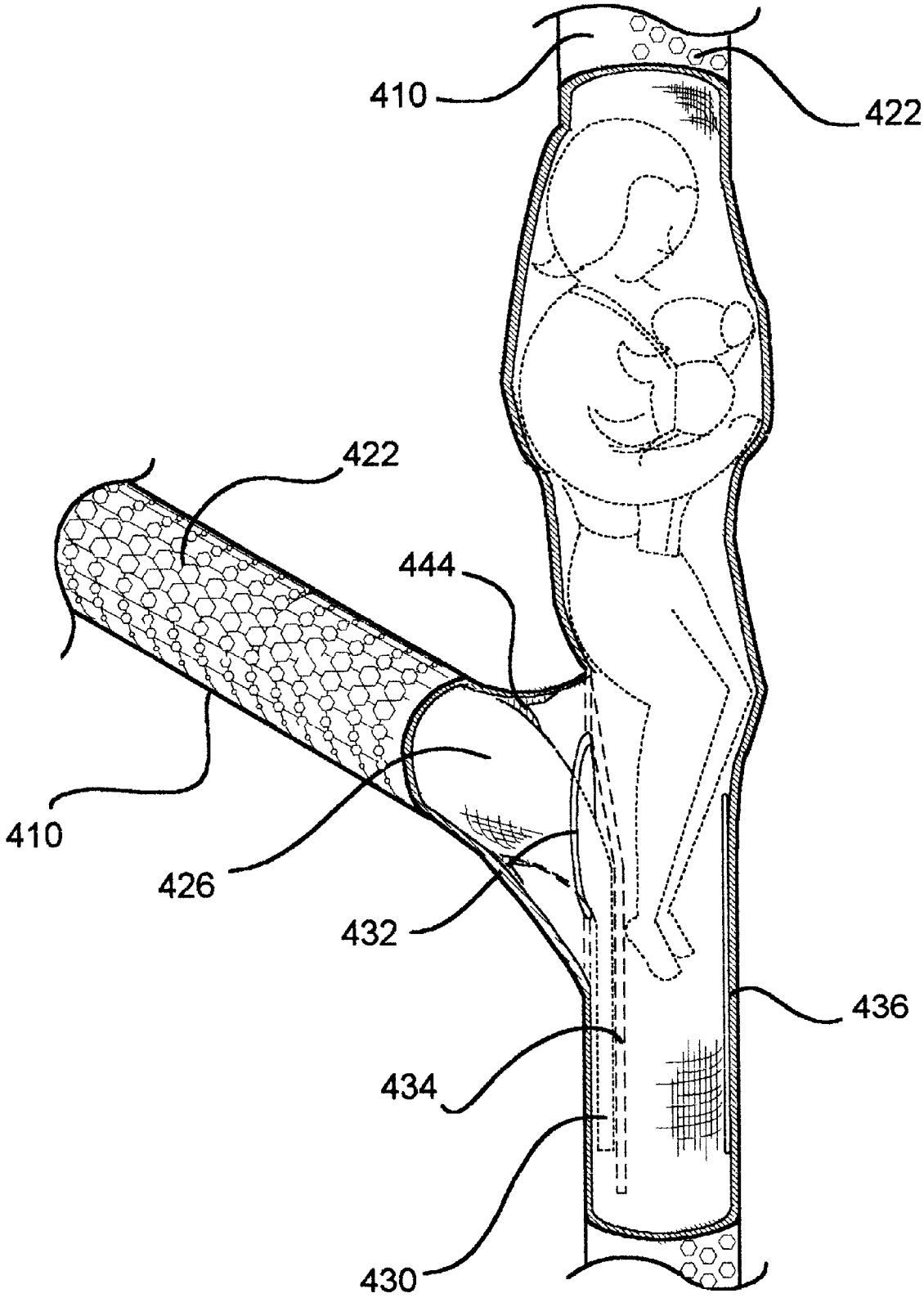

FIG. 4J shows a perspective, cross-sectional view of the descent tube material, sans fire-proof layer for clarity, with an evacuee with child in a recommended harness, in the vertical section of a y-shaped modular descent tube immediately prior to crossing a typical elastic aperture that serves as a transition from diagonal to vertical descent, with particular focus on how the descent tubes are designed to allow evacuees to cross the said apertures safely.

Figure 4K:
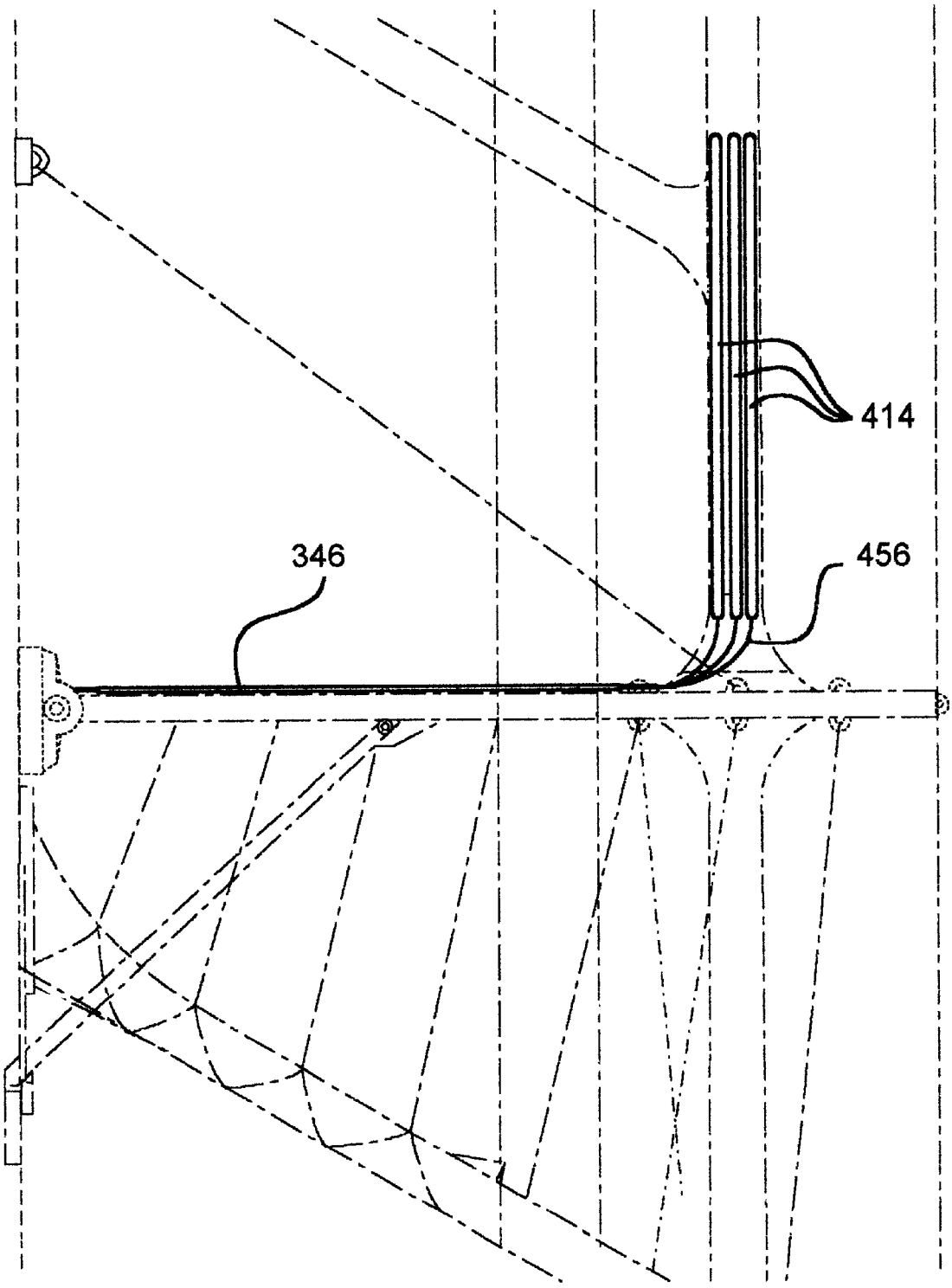

FIG. 4K shows a side view of a building with focus on the position of the fabric sensors internally embedded into the modular descent tubes for avoiding collisions between evacuees using the same modular descent tube.

Figure 4L:
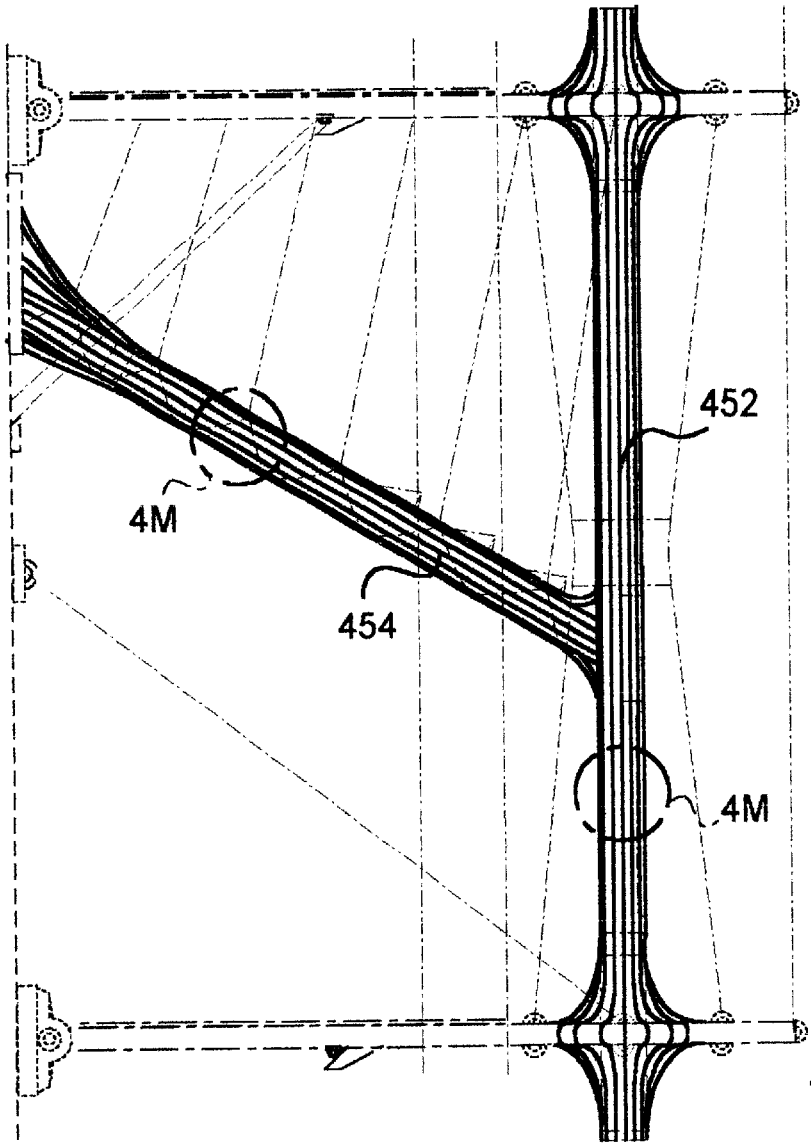

FIG. 4L shows a side view of a building with focus on the positioning of the fiber-optic cables internally embedded into the fire-proof layer on both the diagonal and vertical sections of the modular descent tubes for actively monitoring damage to the descent tube material.

Figure 4M:
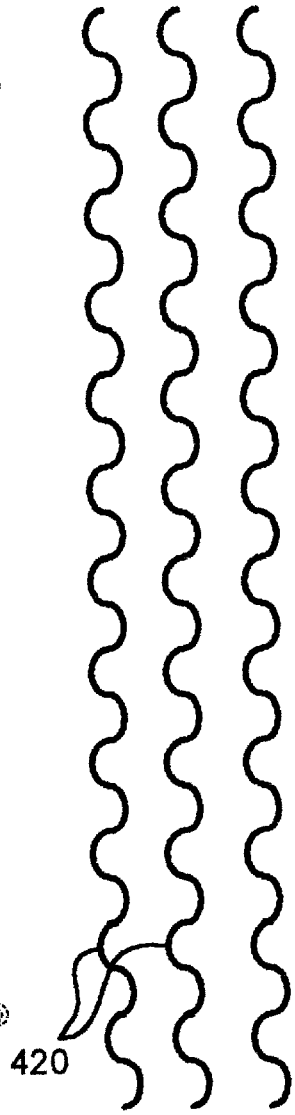

FIG. 4M shows a detailed front view of the waveform shaped fiber-optic cable paths used in FIG. 4L for preventing cable slippage and breaks due to expansion.

Figure 5A:
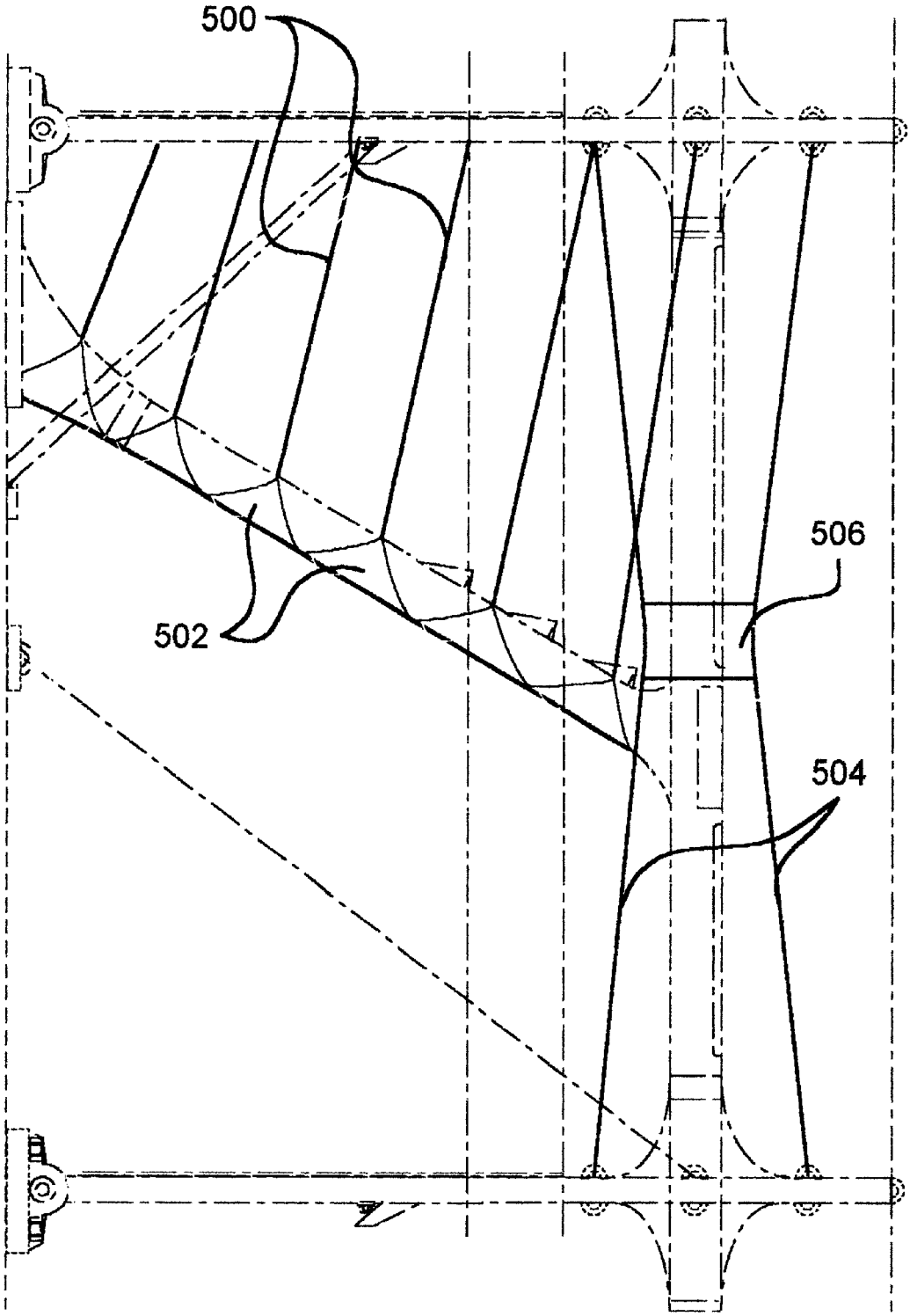

FIG. 5A shows a side view of a building, focusing on the rope webbings and supports for the modular descent tube that prevent excessive sagging or swaying.

Figures 6A, 6B:
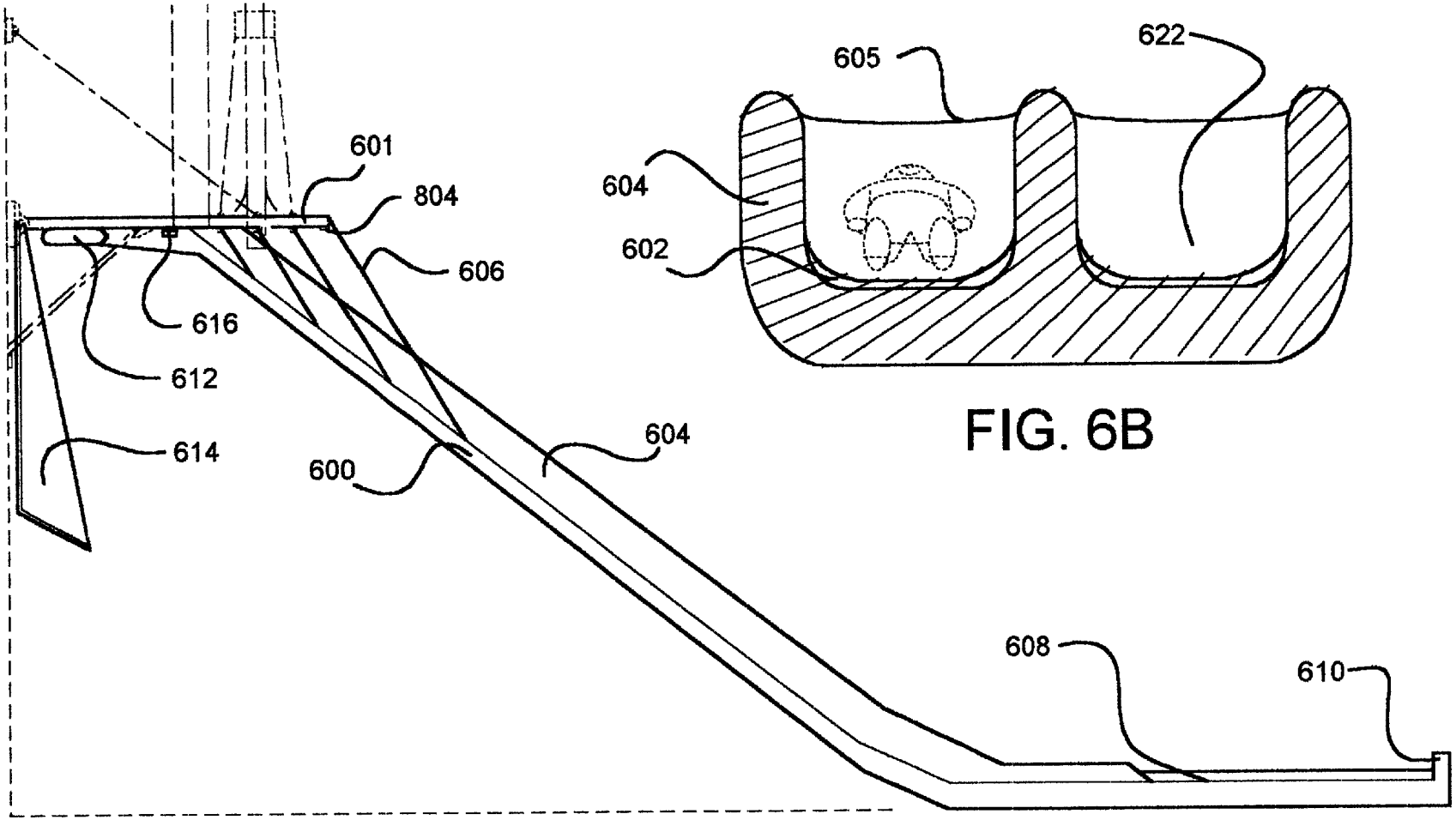

FIG. 6A shows a side view of a building, focusing on a fully-deployed inflatable slide attached to a support pole that is nearest to the ground.

FIG. 6B shows a front, cross-sectional view of the inflatable slide in FIG. 6A, with an evacuee to provide perspective for the height of the safety side walls and two slide channels for increased evacuee volume.

Figure 6C:
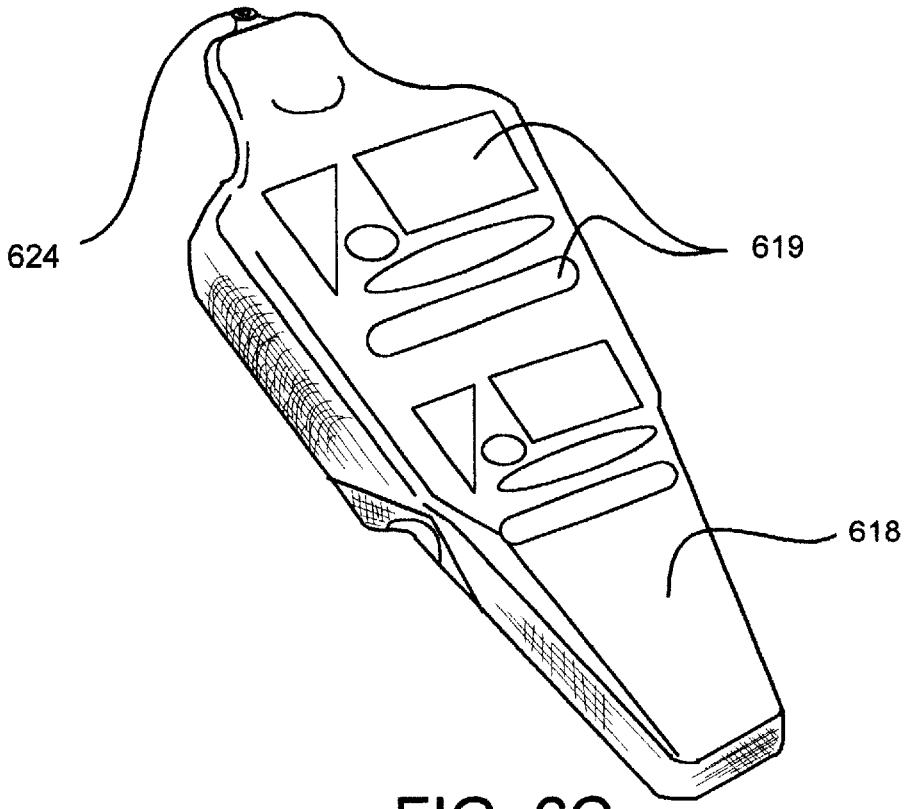

FIG. 6C shows a perspective view of the optional test dummy with passive keyed bands of conductive material on both front and back to facilitate an initial test run of a recently deployed system.

Figure 6D:
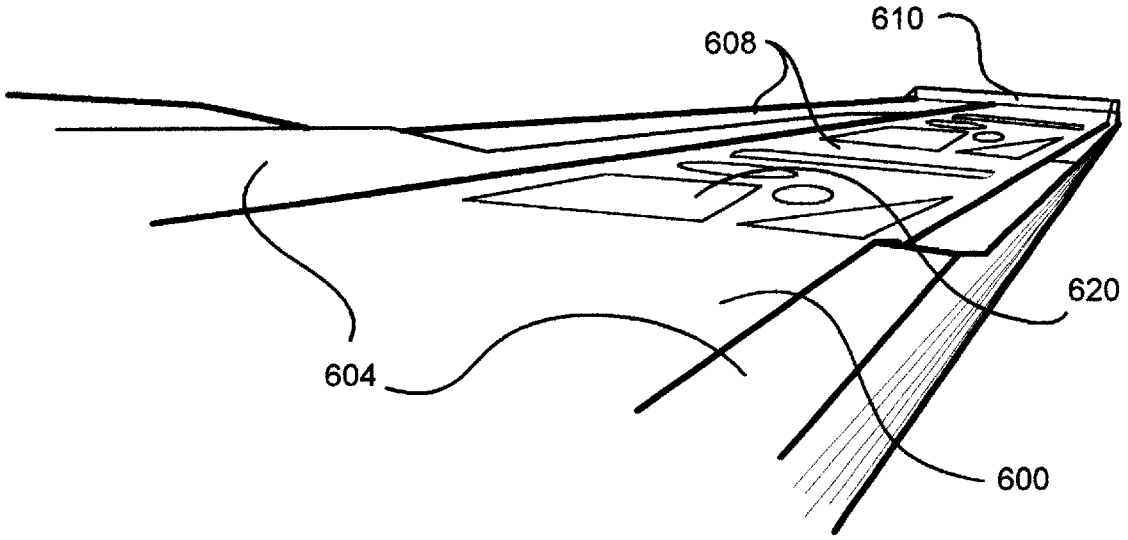

FIG. 6D shows a perspective view of the end portion of the inflatable slide with the optional active keyed bands of conductive material that triggers signaling as the test dummy successfully completes its test run.

Figure 7A:
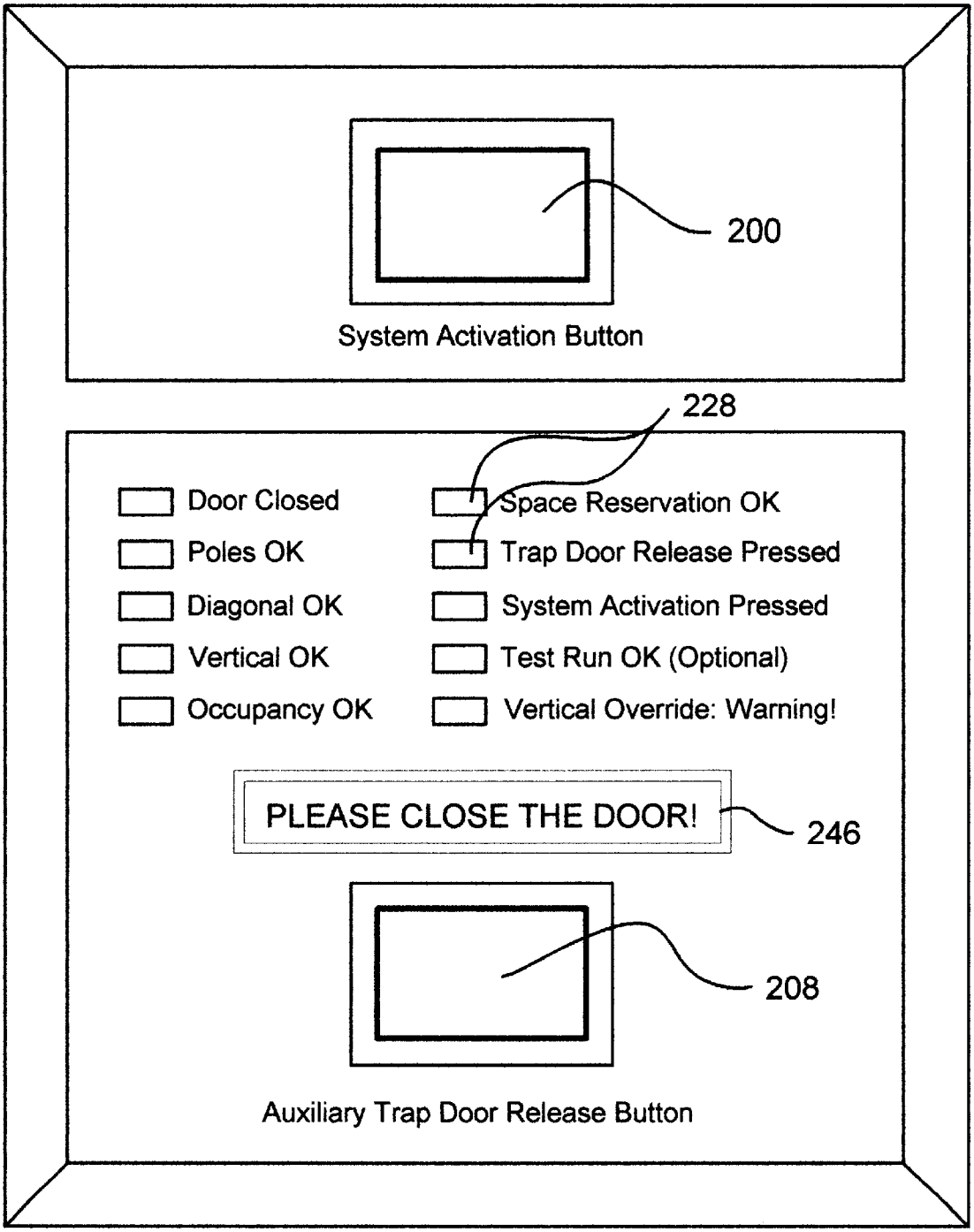

FIG. 7A shows a front view of a glass covered interface panel, positioned immediately outside of the egress booth and also serves as a wiring box, comprised of an auxiliary trap door release button, status light emitting diodes (LEDs) and the system activation button.

Figure 7B:
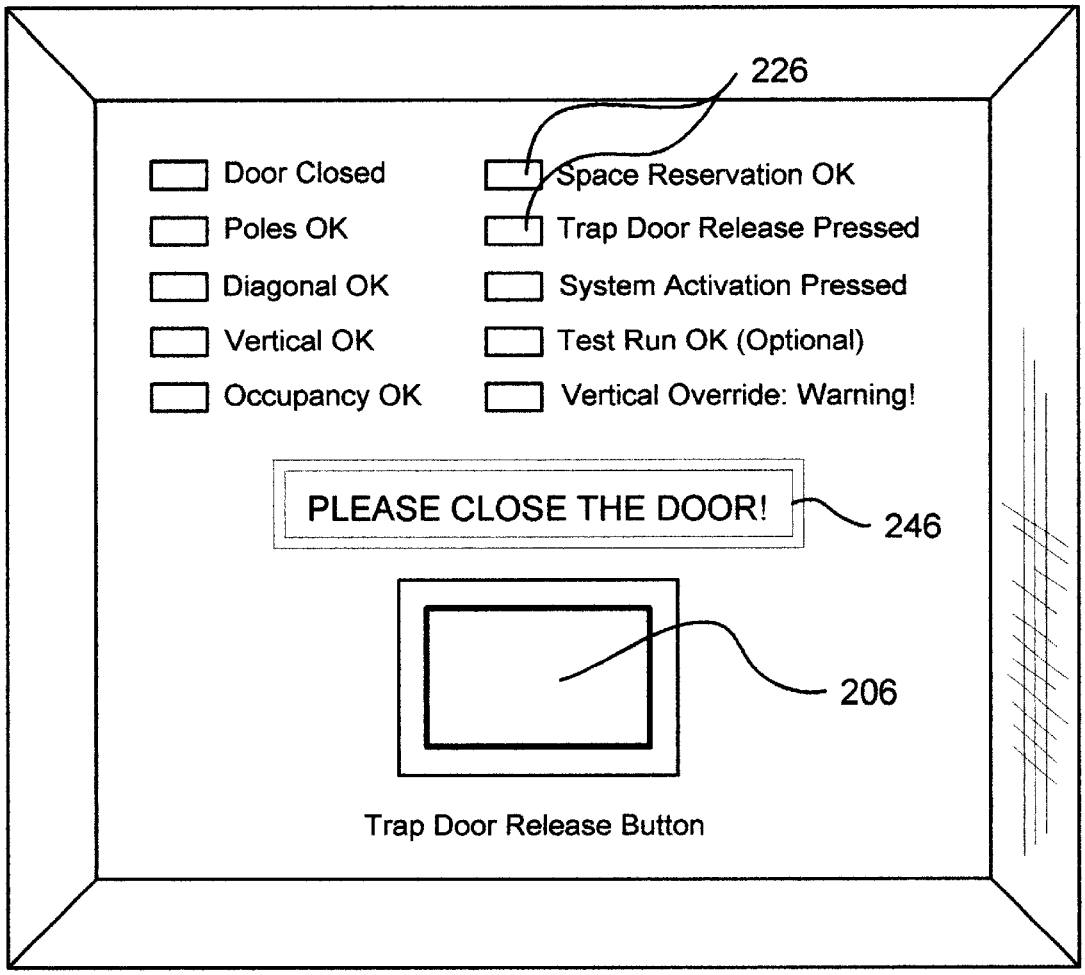

FIG. 7B shows a front view of an interface panel, positioned inside the egress booth, comprised of a trap door release button and status LEDs.

Figure 7C:
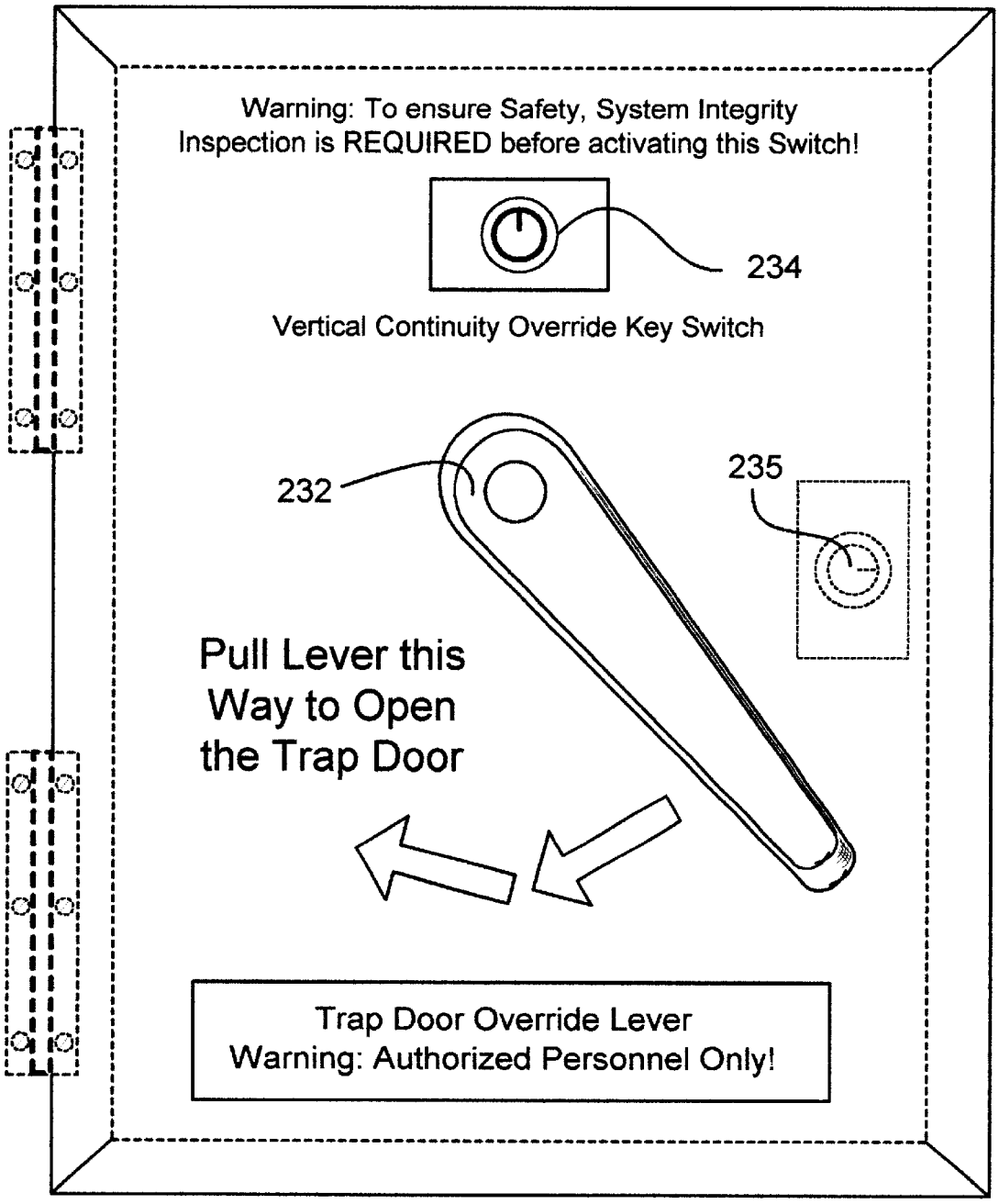

FIG. 7C shows a front view of a normally covered and locked interface panel, located outside the egress booth, comprised of an trap door override lever and vertical continuity check override key switch, generally used exclusively by authorized personnel.

Figure 8A:
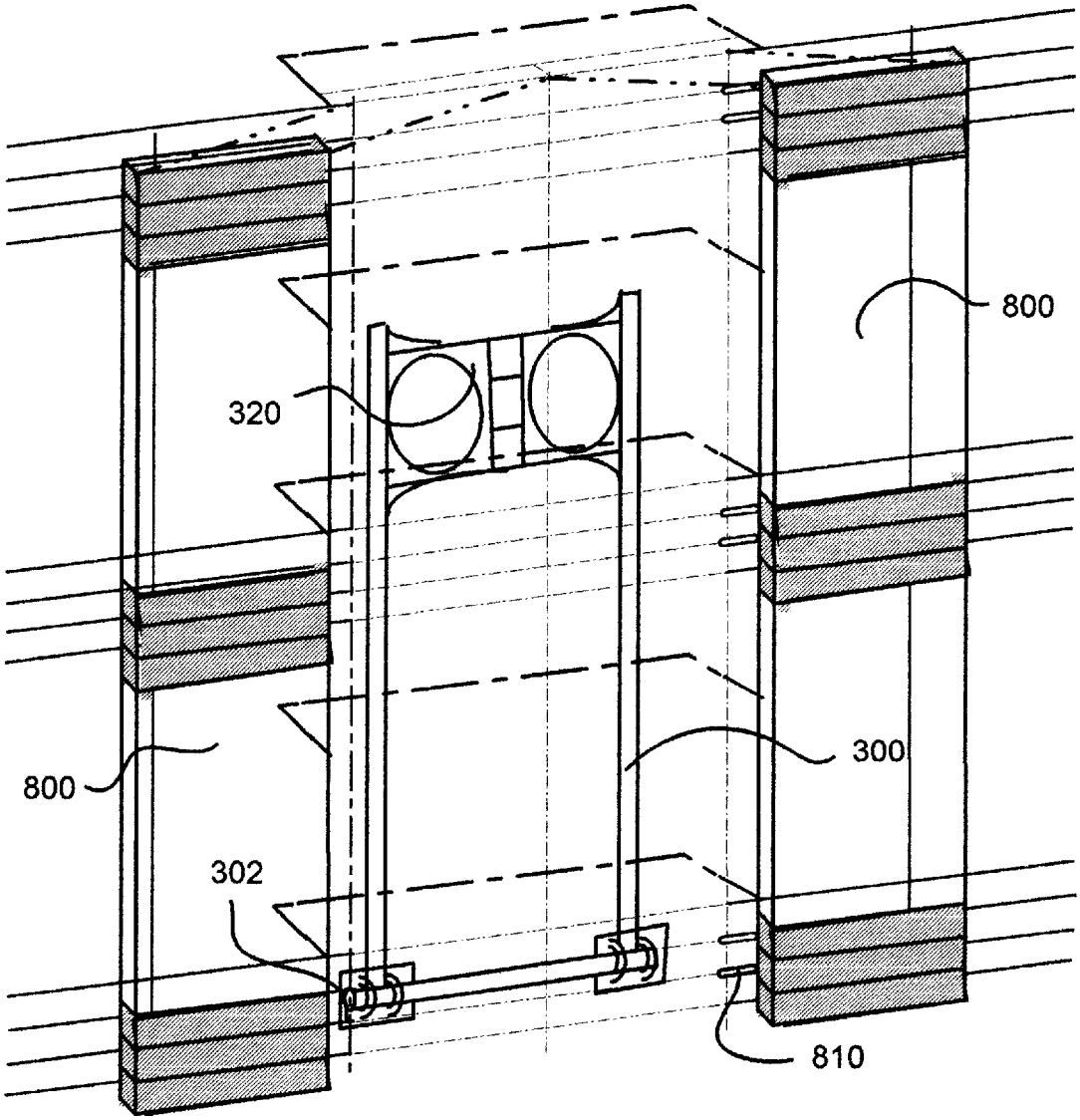

FIG. 8A shows a perspective view of two sliding protective and aesthetic covers for the apparatus.

Figure 8B:
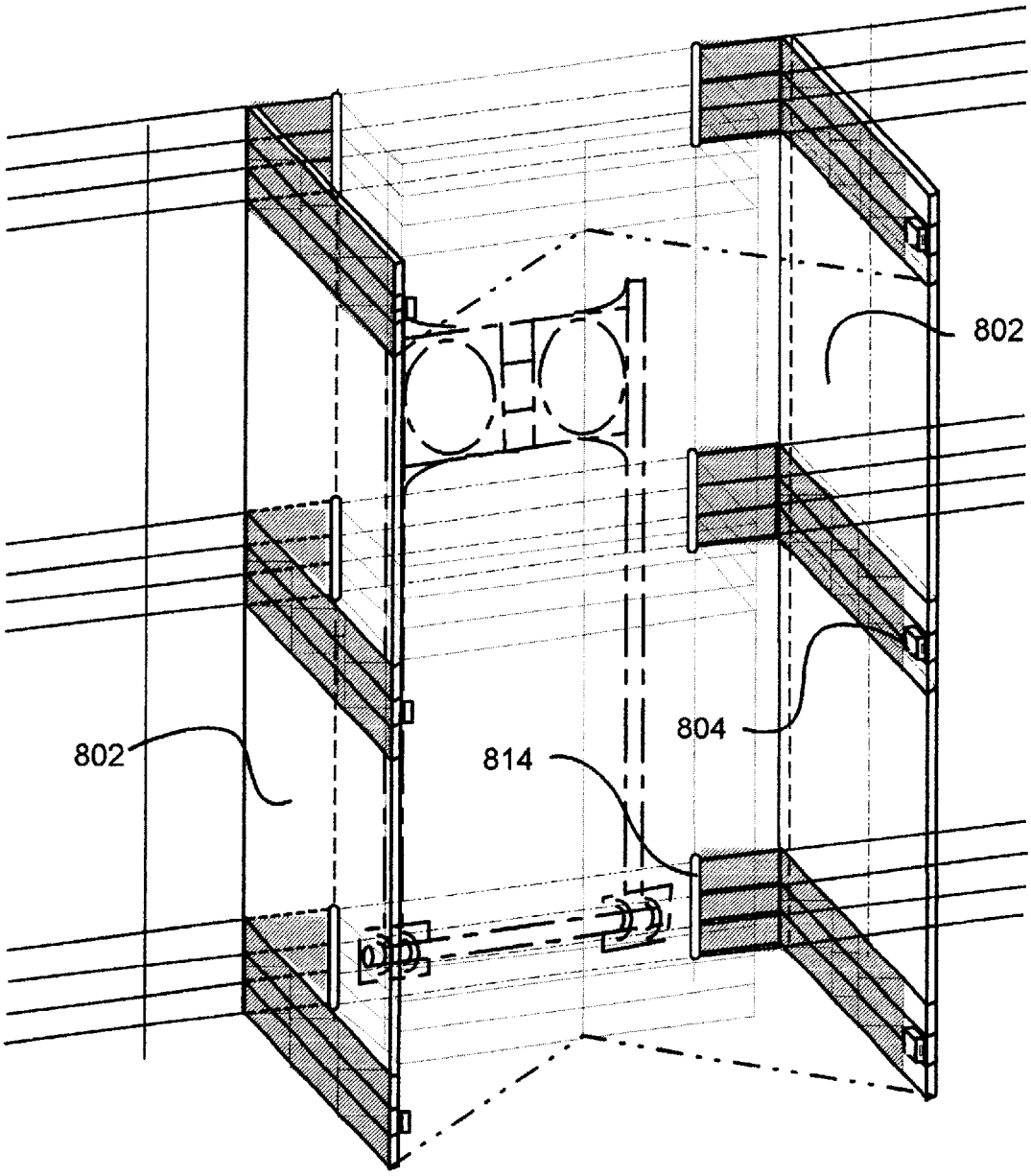

FIG. 8B shows a perspective view of two L-shaped protective and aesthetic covers for the apparatus.

Figure 8C:
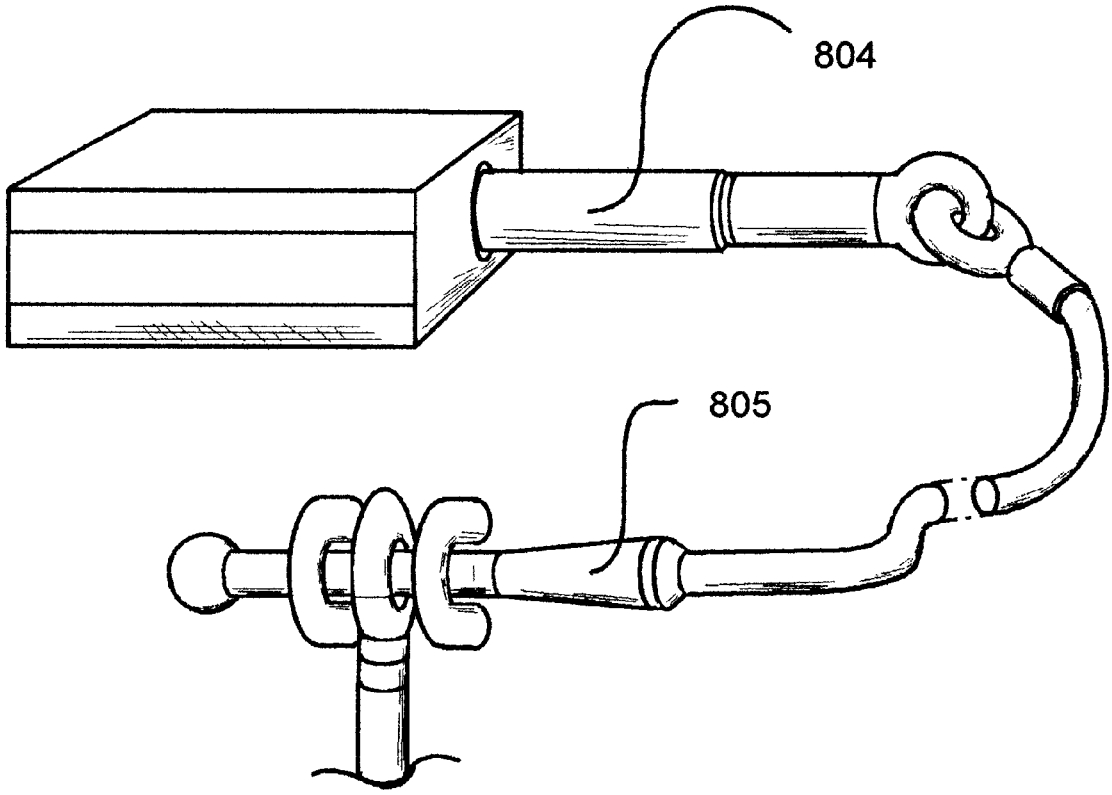
Figure 8D:
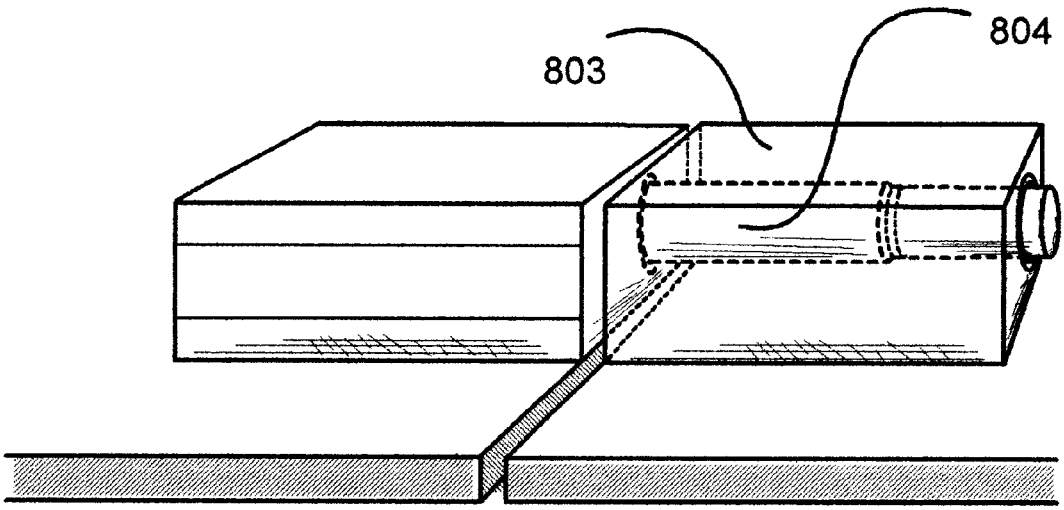

FIGS. 8C and 8D shows a perspective view of two possible versions of magnetic bolt latches used in the apparatus for applicable tasks such as fastening and releasing poles or keeping the protective and aesthetic covers shut.

Figure 8E:
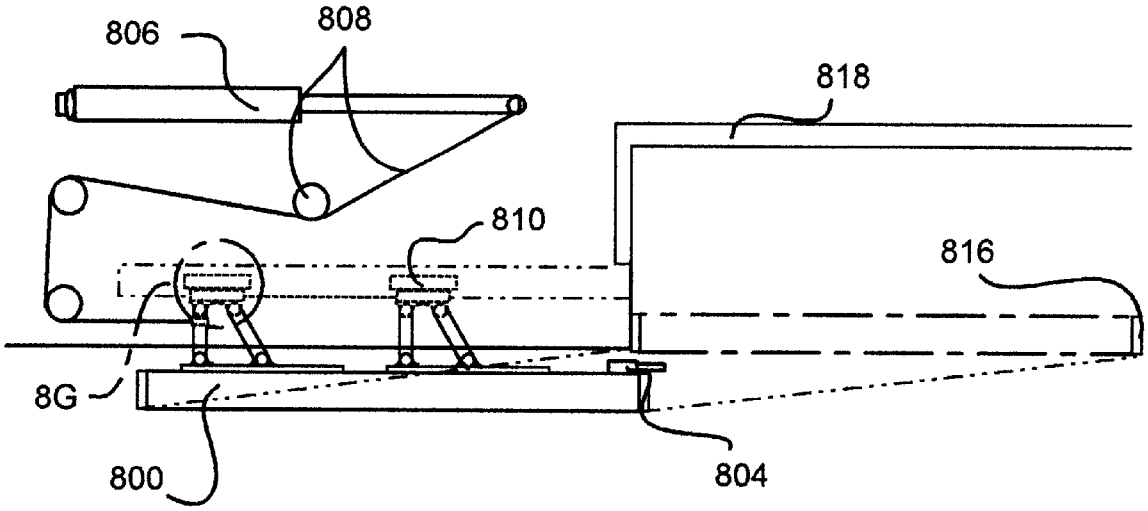
Figure 8F:
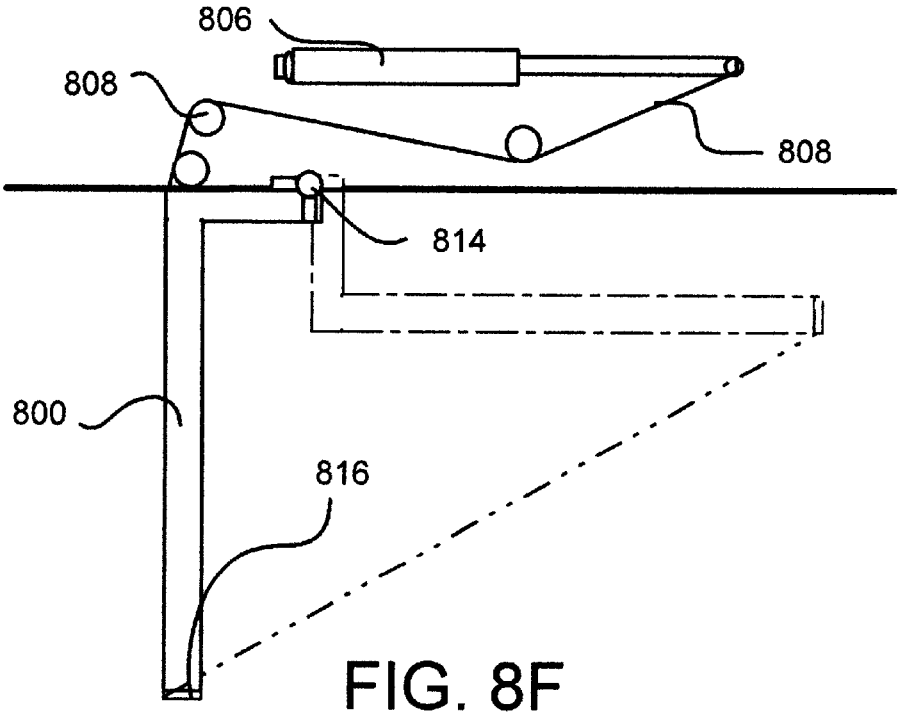
Figure 8G:
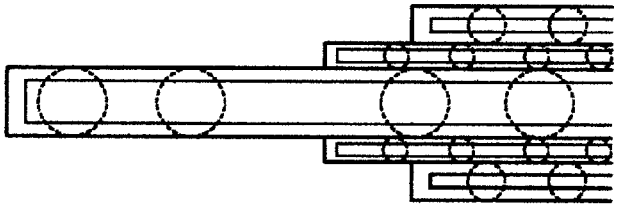

FIGS. 8E to 8G shows a top view of the mechanisms used to open the protective and aesthetic covers without the use of large amounts of electrical power.

Figure 9A:
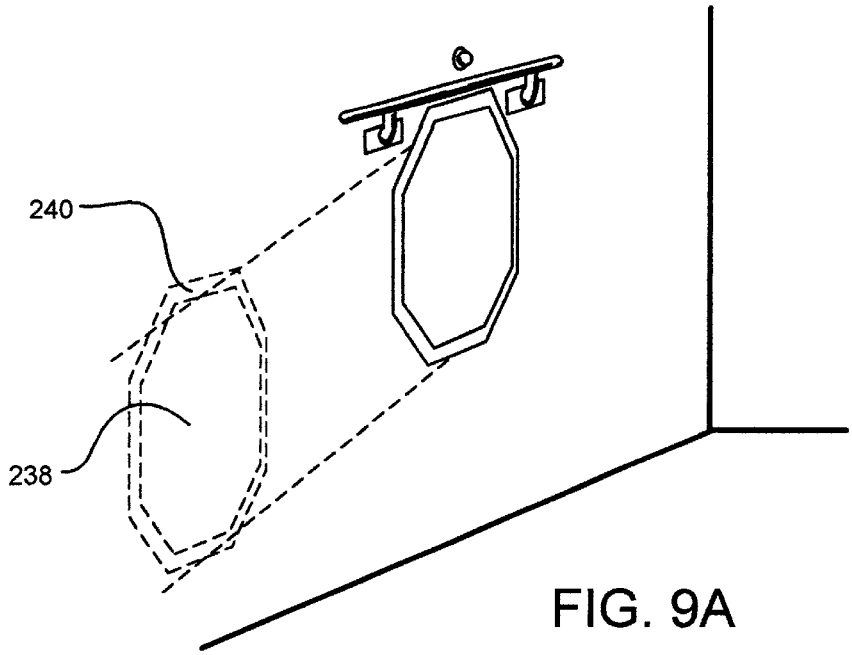

FIG. 9A shows a perspective view of a wall-based alternative embodiment of the system that does not require an egress booth.

Figure 9B:
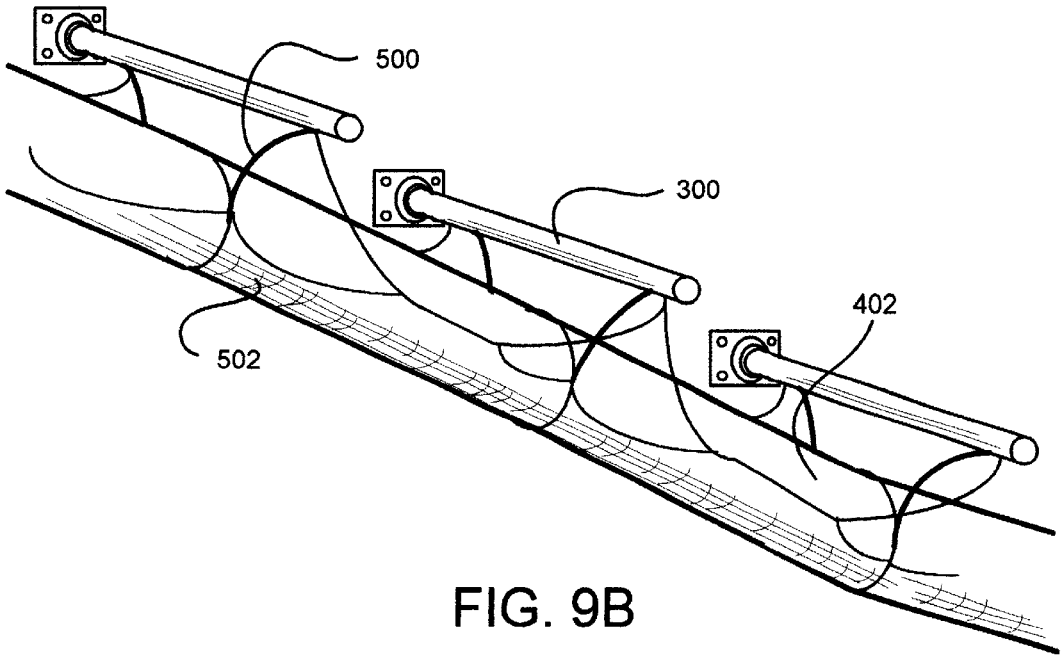

FIG. 9B shows a perspective view of an alternative embodiment of the system focusing on support poles, diagonal descent tubes and support webbings for primarily diagonal descent.

Figure 9C:
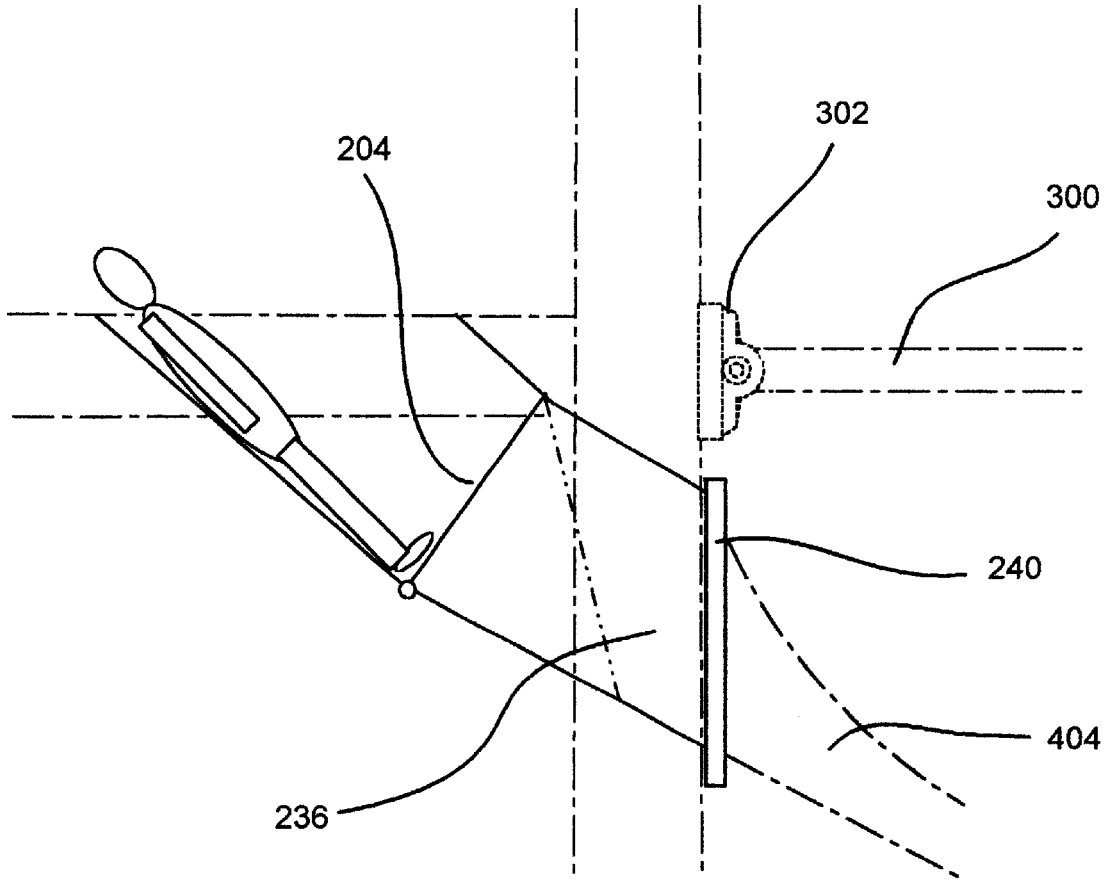

FIG. 9C shows a building side view of a floor-based alternative embodiment of the system that also does away with the egress booth.

Figure 9D:
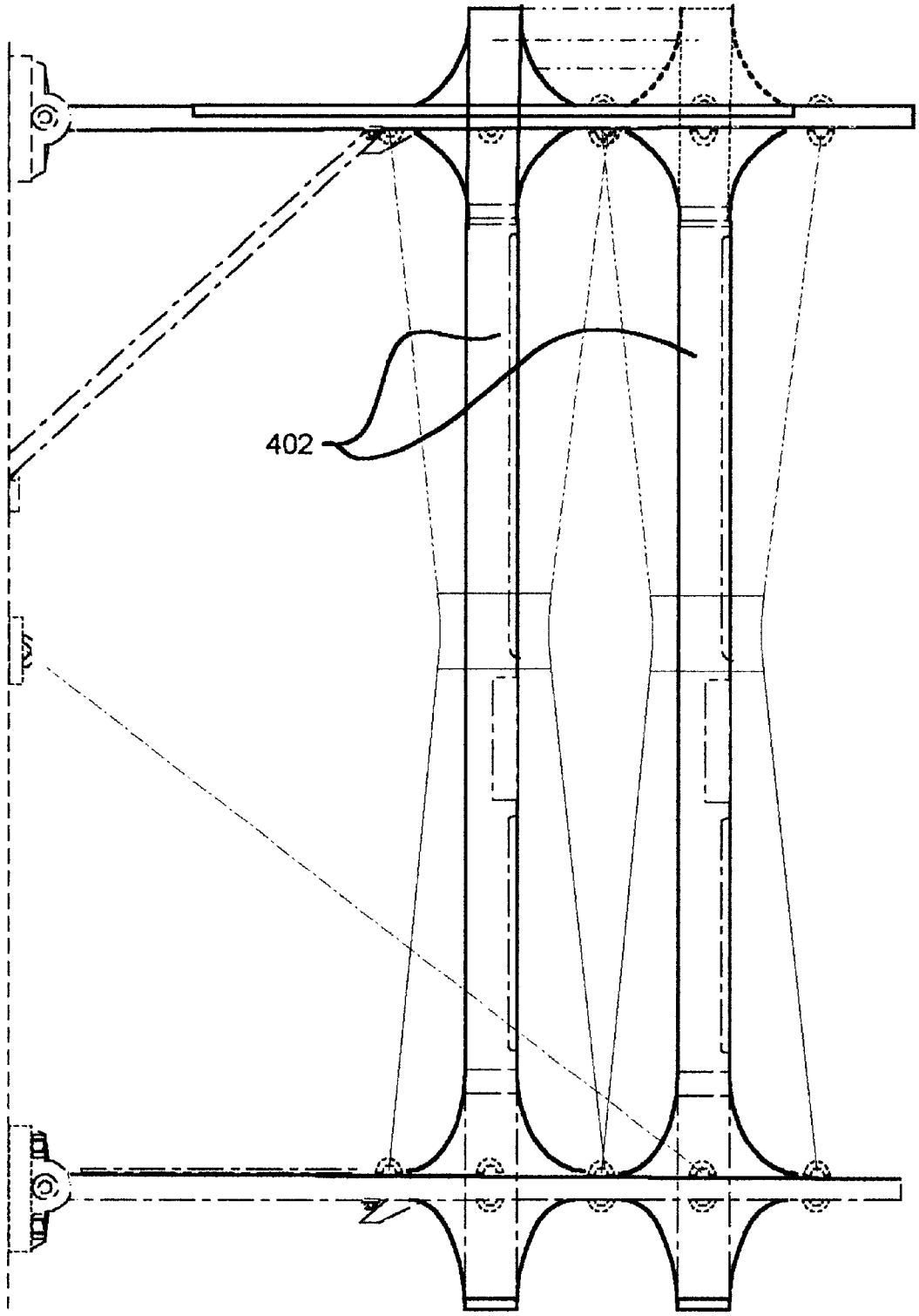

FIG. 9D shows a building side view of an alternative embodiment of the system that supports an evacuee re-routing feature by utilizing a top sliding truss and four bottom descent tubes instead of the usual two.

FIG. 10A is a flowchart that details the step-by-step process and procedures used in the system, to significantly reduce any questions or ambiguity with regard to wiring and other related issues by those who are skilled in the art.

Figure 10B:
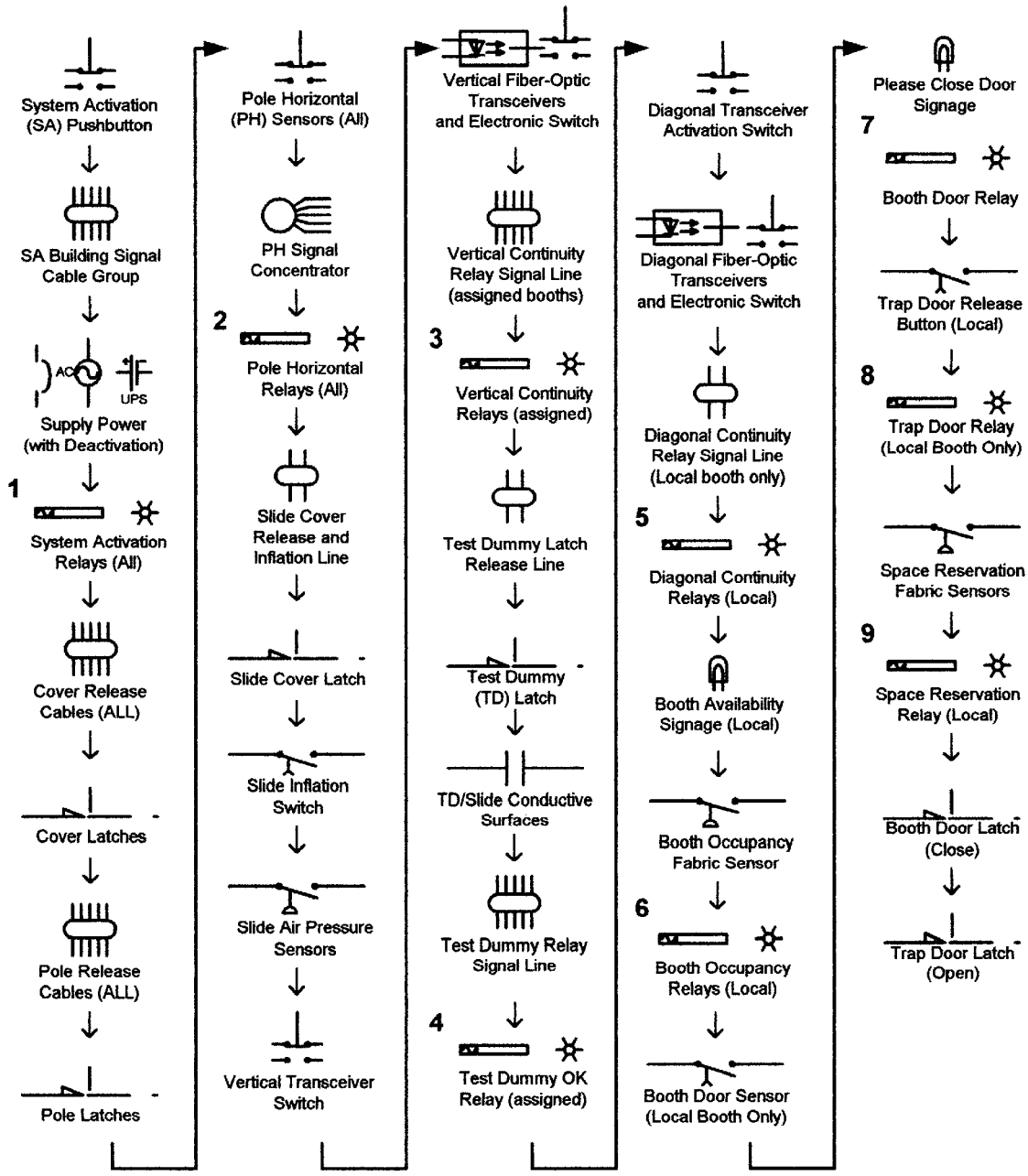

FIG. 10B is a schematic summary of the relationships between active components used in the system.

Reference Numerals in Drawings

200 System Activation Button
202 Egress Booth
204 Trap Door
205 Trap Door Hinge
206 Internal Trap Door Release Button
208 Auxiliary Trap Door Release Button
210 Booth Occupancy Fabric Sensor
212 Trap Door Calibrated Damper Rod
214 Trap Door Magnetic Bolt Latch
215 Trap Door Open/Closed Sensor
216 Cylindrical Door
218 Cylindrical Door Sensors
220 Cylindrical Door Open/Closed Position Locking Gear
221 Cylindrical Door Magnetic Bolt Latch (while Trap Door is open)
222 Cylindrical Door Handle and Lever
224 Bearing Rails
226 Internal Light Emitting Diode (LED) Display Board
228 Auxiliary LED Display Board
230 Overhead Light
232 Manual Override Lever for Trap Door with Protective Cover
234 Vertical Continuity Override Key Switch
235 Override Cover Key Lock
236 Passageway
238 Circular Aperture with Rounded Edges and Padding
240 Elliotially-shaped truss (Building Wall for Diagonal Tube Attachment)
244 Egress Booth Availability Signage
246 Signage, "Please Close the Door"
300 High-tensile strength Steel Support Poles
302 High-tensile strength Hinges
304 Cable Anchors (for Fixed Length Cable)
306 Fixed Length Cables
308 Nautilus-shaped Disks
310 Horizontal Sensor Switches
312 Bottom-side Struts
314 Maximum Travel Lock
316 Strut Rail and Guide
318 Gas-lift Rod
320 Octagonally-shaped trusses
321 Five-bar Truss for Vertical Descent Tube Ends Attachment
324 Forged bends
326 Clamps and Fastening Bolts
328 Reinforced Edge of Fire-Proof Material (for Truss Attachment)
330 Arched Attachment Bar
332 Continuous Vertical Fire-Proof Material Shield
334 Support Arches
336 Horizontal Bars
340 Webbing Cable Anchor Points
342 Crane Motor
344 Crane Cable
346 Internally Insulated Pipes
348 Topmost Pole Truss Suspension Arm
352 Last Support Pole nearest to the Ground
400 Y-Shaped Modular Descent Tube
402 Cylindrical Modular Descent Tube
404 Diagonal Section of Y-Shaped Modular Descent Tube
406 Vertical Section of Y-Shaped Modular Descent Tube
408 Single-Piece Cargo Netting
410 Breathable Cladding for Cargo Netting
412 Breathable Elastic Lattice
413 Vertical Strips of Ultra High Molecular Weight Poly-Ethylene (UHMWPE) Material
414 Vertical Section Fabric Sensor
415 Funnel
416 Fireproof material (such as Nomex (™))
418 Base of z-patten folds
420 Waveform Cable Paths
422 Air Holes/Breathing Apertures
424 Vertical Elastic Lattice
426 Diagonal Elastic Lattice
428 NON-stick substance (i.e. PTFL or Teflon™)
430 Extra Length of Breathable Elastic Lattice from the Diagonal Section
432 Reinforced Opening In Vertical Section Elastic Lattice and Cargo Netting
434 Cover Flap
436 Extra Cordura Shield
438 Fixed-tension UHMWPE netting
440 Elastic Support Band
442 Elastic Material Reinforced Edges
443 Reinforced Cargo Netting Edges
444 Reinforcement Material
445 Truss Foam Padding
446 Breathable Elastic Lattice Tail
448 Vertical Ventilation Openings
450 Overhead Netted Ventilation Openings
452 Single-mode Fiber-optic Cable
454 Multi-mode Fiber-optic Cable
455 Reserved Slack
456 Fabric Sensor Cables
460 Horizontal Segments of Cargo Netting
462 Vertical Segments of Cargo Netting
500 Webbing Ropes
502 Diamond-shaped Cordura (™) and UHMWPE material
504 Vertical Section Stabilizer Webbing Cables/Ropes
506 Nomex (™)-covered Cordura (™) and UHMWPE Stabilizer Ring
512 Rock Climbing Rope Locks
600 Inflatable Slide
602 Surface Reinforcements
604 High Side Walls and Cover Netting
606 Slide Support Webbings
608 Evacuee Receiving Area
610 Catch Wall
612 Air Cylinders with Aspirators
614 Protective Cover
616 Air Pressure Sensors
618 Test Dummy with Keyed Bands of Conductive material

619 Passive Keyed Bands of Conductive material
620 Active Keyed Bands of Conductive material and Switch
622 Slide Channel or Path
624 Test Dummy Suspension Loop
700 Fiber-optic Transceivers and Electronic Switches
702 Copper Cabling (for Trap Door Control Signals)
704 Low-voltage Electrical Relays (for Trap Door Magnetic Bolt Latch Release)
705 Wiring Box
706 Uninterruptible Power Supply (UPS) for extended system signals
708 UPS for local system signals
709 System Deactivation Key Switch
800 Sliding Door
802 L-shaped Hinged Door
803 Bolt Catch
804 Magnetic Bolt Latch
805 Rubber-ended Release Pin
806 Gas-lift Rods
808 Cables and Pulleys
810 Rail Guides
812 Extensible Rails
814 Hinges
816 Weather Seal
818 Barrier

DETAILED DESCRIPTION OF THE PREFERRED EMBODIMENT

Just as a skyscraper is the successful embodiment of a very complex combination of engineering formulas, each individual component used in the present invention solves a long-felt, long-existing need by acting as a synergistic whole.

To facilitate writing, the lengthy detailed description is very roughly subdivided into sections composed of the present invention's major components, since the interrelationships between these components easily cross the intended descriptive subdivisions. The major components are:

I. Protective and Aesthetic Covering

II. Support Poles

III. Egress Booth and Trap Door

IV. Modular Descent Tubes

V. Sensors and Switches

VI. Truss Design and Strategies for Volume

VII. Stabilizer Webbing and Supports

VIII. Inflatable Slide and Test Dummy

IX. Control Signals

Trademarked names (such as Nomex, Cordura, Lycra and Teflon—all manufactured by DuPont) that may be used throughout this document does not imply that only these exact brands are recommended. Rather, these names are only used to facilitate writing by conveying of the inherent characteristics of the material in a single word. Other brands with the same or better characteristics than the trademarked materials may be used for as long as the safety features are well considered as in the previously mention case of Keviar (™) in the Background—Description of Prior Art section of this document.

I. Protective and Aesthetic Covering

A successful cover for the apparatus preserves the building's aesthetics by mimicking the visual characteristics of a building's external materials and shape, such that it is virtually unnoticeable to pedestrians looking at the building. The cover should also adequately protect the apparatus against the elements.

The preferred embodiment for the covering uses a combination of glass and steel that is so common in today's high-rise edifices. However, it should be noted that the exact combination of materials will depend on the existing material used on a building to which the present invention will be affixed.

The protective and aesthetic covers are well-balanced and lubricated 'doors' that mimic building windows panels. They are designed as either sliding doors 800 or L-shaped hinged doors 802 shown in FIGS. 8A and 8B, respectively. These doors are held firmly in place by magnetic bolt latches 804 comparable to that manufactured by SDC Security (www.sdcsecurity.com) as shown in FIG. 8D. Weather seals line the edges of the covers to keep the elements from entering the building as shown in FIGS. 8E and 8F.

When the system activation button 200 shown in FIG. 7A is pressed, the magnetic bolt latches 804 are released. Custombuilt gas-lift rods 806 similar to that manufactured by Stabilus of Germany (www.stabilus.com), and a system of cables and pulleys 808 are simultaneously triggered to push the covers open. Hinges 814, or rails 812 with rail guides 810 allow the doors to be suspended and moved to an open position. A barrier 818 comprised of concrete or glass prevents building occupants from falling through the created opening, as shown in FIGS. 8E and 8F.

By using gas-lift rods 806 to open the doors, the need for a great and steady amount of electricity is precluded, and this is beneficial during a major crisis, as the regular amount of power may not be available. Inwardly-moving sliding doors 800 are preferred, whenever building design permits.

The interaction between active electronic components involving the above mentioned system activation button and magnetic bolt latches is summarized in FIGS. 10A and 10B.

II. Support Poles

Figure 3A:
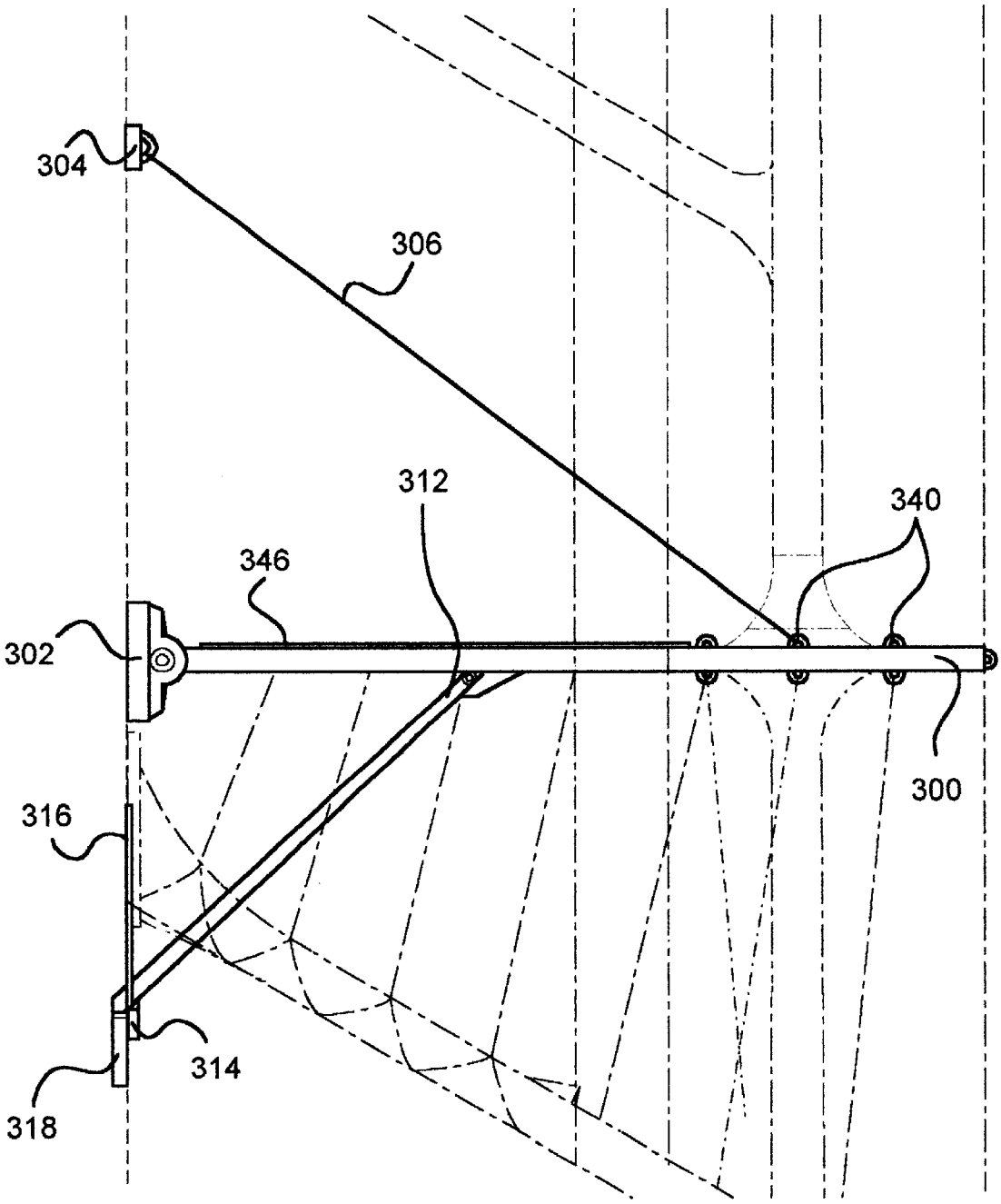
FIG. 3A shows a side view of a typical support pole.
Figure 3B:
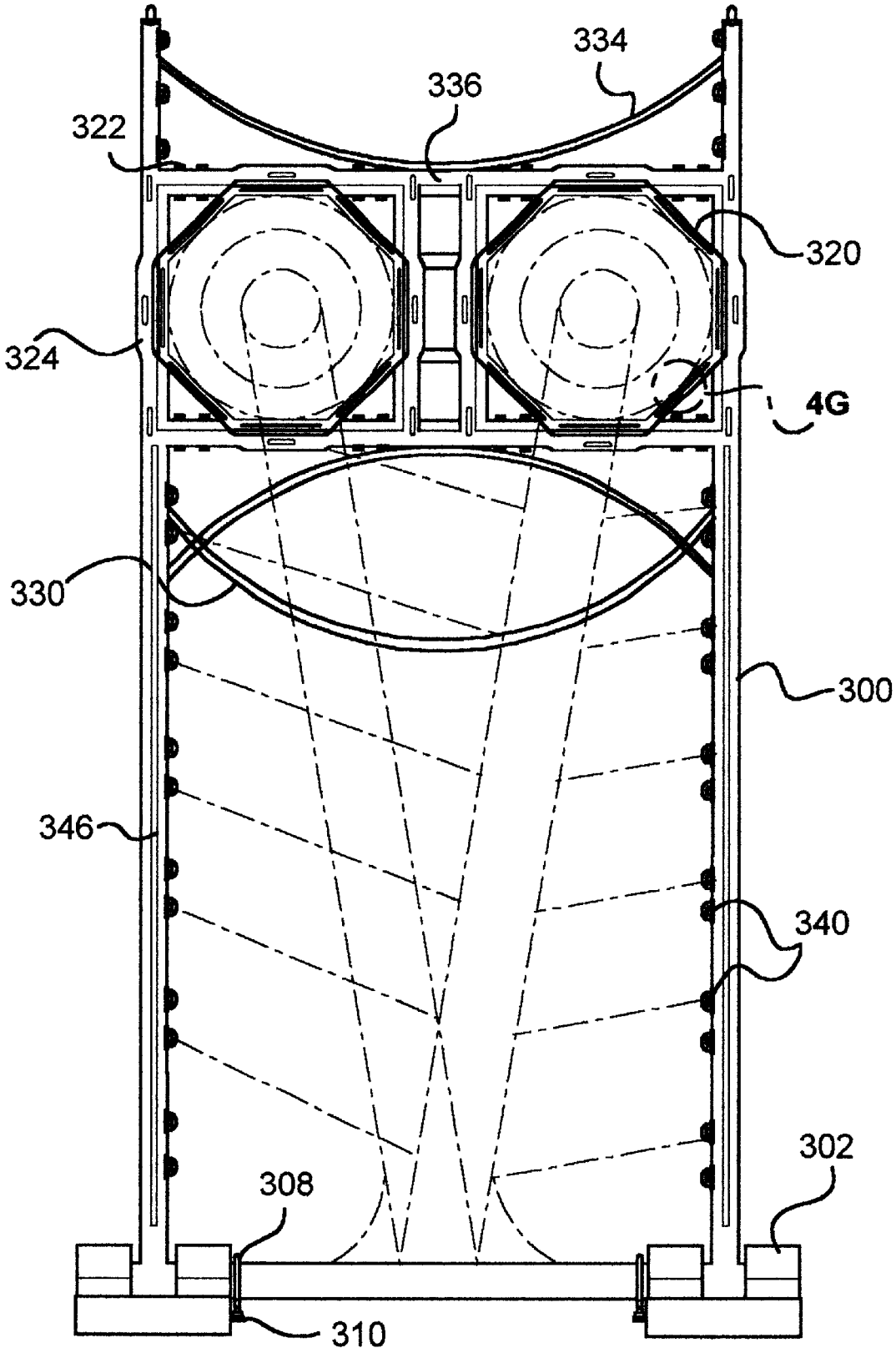
FIG. 3B shows a top view of the support pole and a pair of octagon-in-square trusses with guide lines that depict how diagonal descent tubes are alternately positioned and supported in relation to the support pole.
Figure 3C:
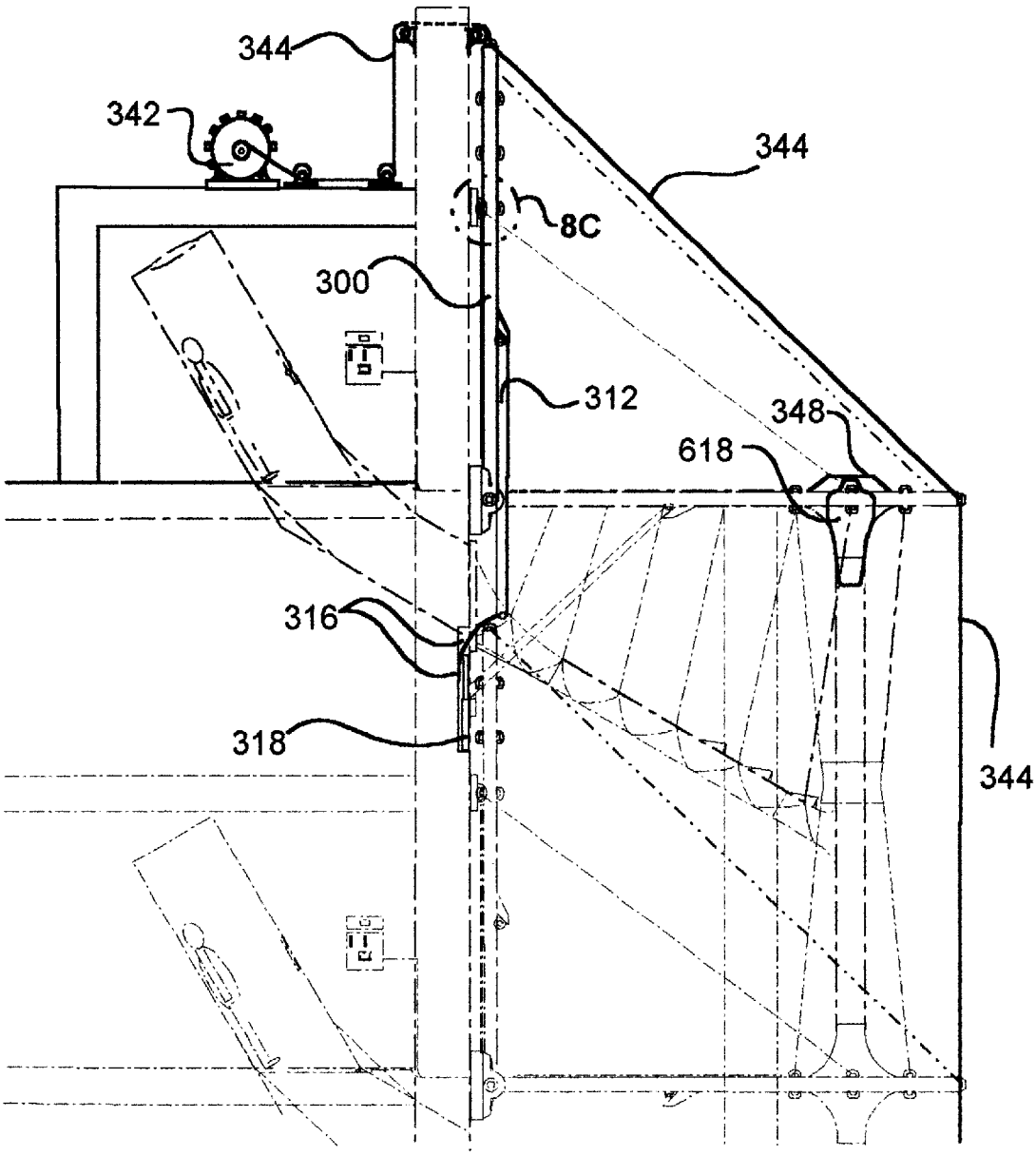
FIG. 3C shows a side view of the topmost floor of the building generally focusing on the pre-deployment position of the support poles including the crane motor, drum and cables that return the said poles after use.

The following description relates to FIGS. 3A to 3C. Once the gas-lift rods 806, used to open the protective and aesthetic covers 800 or 802, have been fully opened, the tip of the gas-lift rods activates switches that disengage magnetic bolt latches 804 show in FIG. 8C, and frees all high-tensile strength steel support poles 300 and its attached trusses 320 from its vertical position as shown in FIG. 3C. The support poles are attached onto the superstructure of the building by high-tensile strength steel hinges 302 that are bolted and welded directly onto the building superstructure. These support poles simultaneously move from a vertical to a horizontal position with its descent carefully controlled by a bottom-side support strut 312 led by a strut rail and guide 316 that compresses a fully extended industrial-grade gas-lift rod 318 until obstructed by a maximum travel lock 314. Fixed-length cables 306, cable anchors 304 welded and bolted onto the building's superstructure, including bottom-side struts 312 and maximum travel lock, 314 firmly establishes the support pole at a horizontal position. As shown in FIG. 3A. A nautilus-shaped disk 308 at the base of the support pole activates a weather-proof horizontal sensor switch 310 shown in FIG. 3B, which indicates that horizontal rest position has been reached and maintained.

The interaction between active electronic components involving the above mentioned horizontal sensor and magnetic bolt latches are summarized in FIGS. 10A and 10B.

A single crane motor 342 near or at the top floor of the building is connected to the topmost support pole by a crane cable 344 and is used to return all support poles simultaneously to pre-deployment position, but only after strict and careful inspection of the whole system as shown in FIG. 3C. Note that the crane motor 342 is not needed to deploy the support poles. It is instead the use of gas-lift rods 318 on the bottom-side struts 312 that swiftly but carefully deploys the support poles without the need for a large and steady amount of electrical power that may not be available during a major crisis. Whenever building design permits, these support poles should be positioned along the comers rather than the center of the building III. Egress Booth and Trap Door Shown in FIG. 2A, the primary portal for exiting the building with minimum effort and reasonable speed is a cylindrical egress booth 202 that is slanted at about sixty degrees. This booth can support a large adult in excess of six feet in height, two smaller adults, or an adult with a child or infant at a time. It has an overhead light 230 and a special internal cylindrical door 216 shown in FIG. 2C, made of transparent nontoxic window-grade material such as Lexan (™) polycarbonate similar to that manufactured by GE Plastics (www.geplastics.com). The cylindrical door is sandwiched between the walls of the egress booth. The cylindrical door generally rotates in one direction only, supported by a bearing rail 224. Its rotation is stopped at predetermined, alternating open or close positions by a locking gear 220 that is released by depressing a lever 222 found the door handle. The cylindrical door has four available door handles for each alternating open and closed position, but only one handle is exposed at any given time. Moreover, the cylindrical door has sensors 218 that indicate whether it is in a close or open position.

Figure 1A:
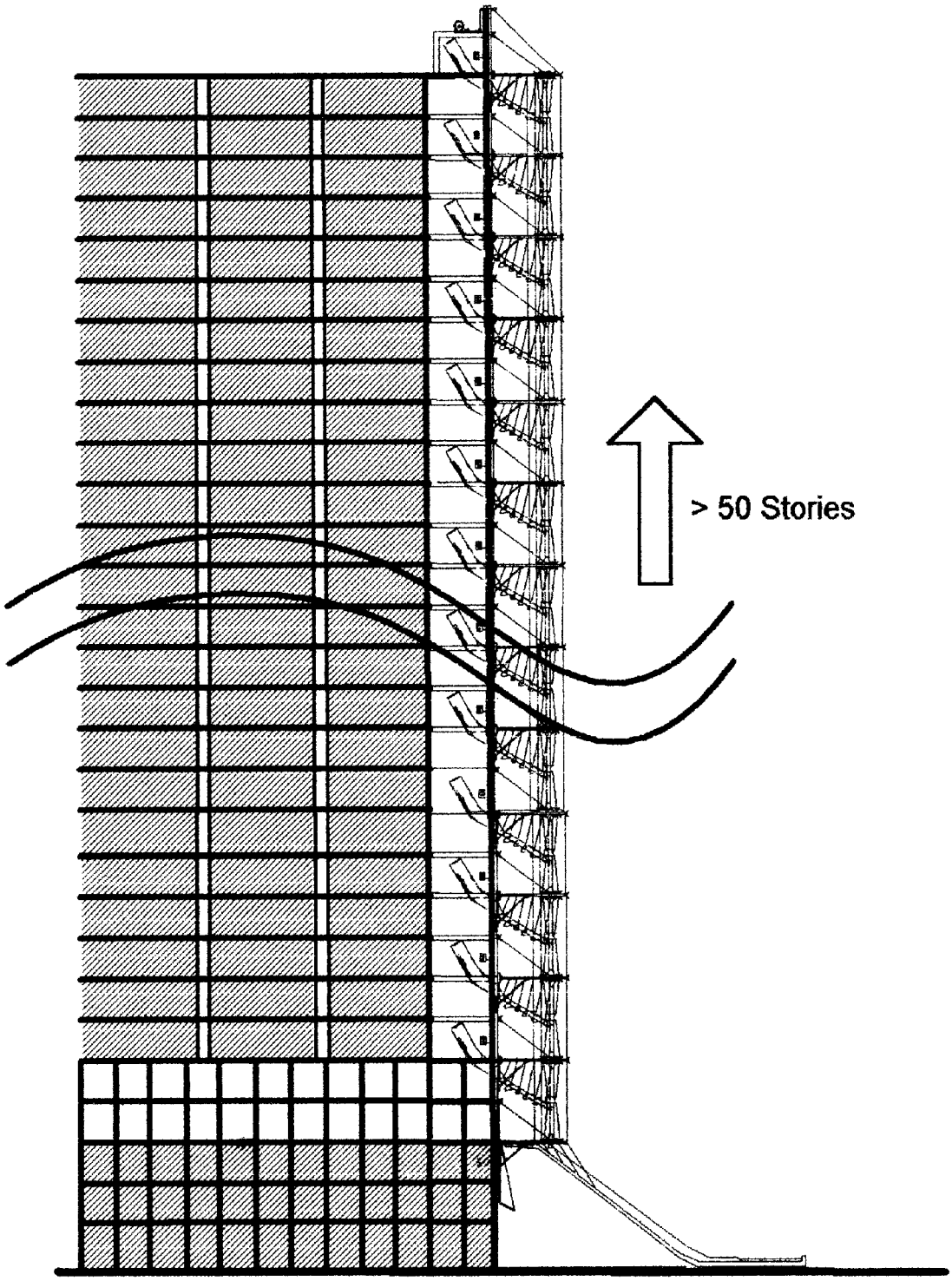
FIG. 1A shows a side view of an abbreviated high-rise building with internal and external components of the present invention visible, so as to facilitate the understanding of relative size and position of the system in relation to the building.
Figure 2A:
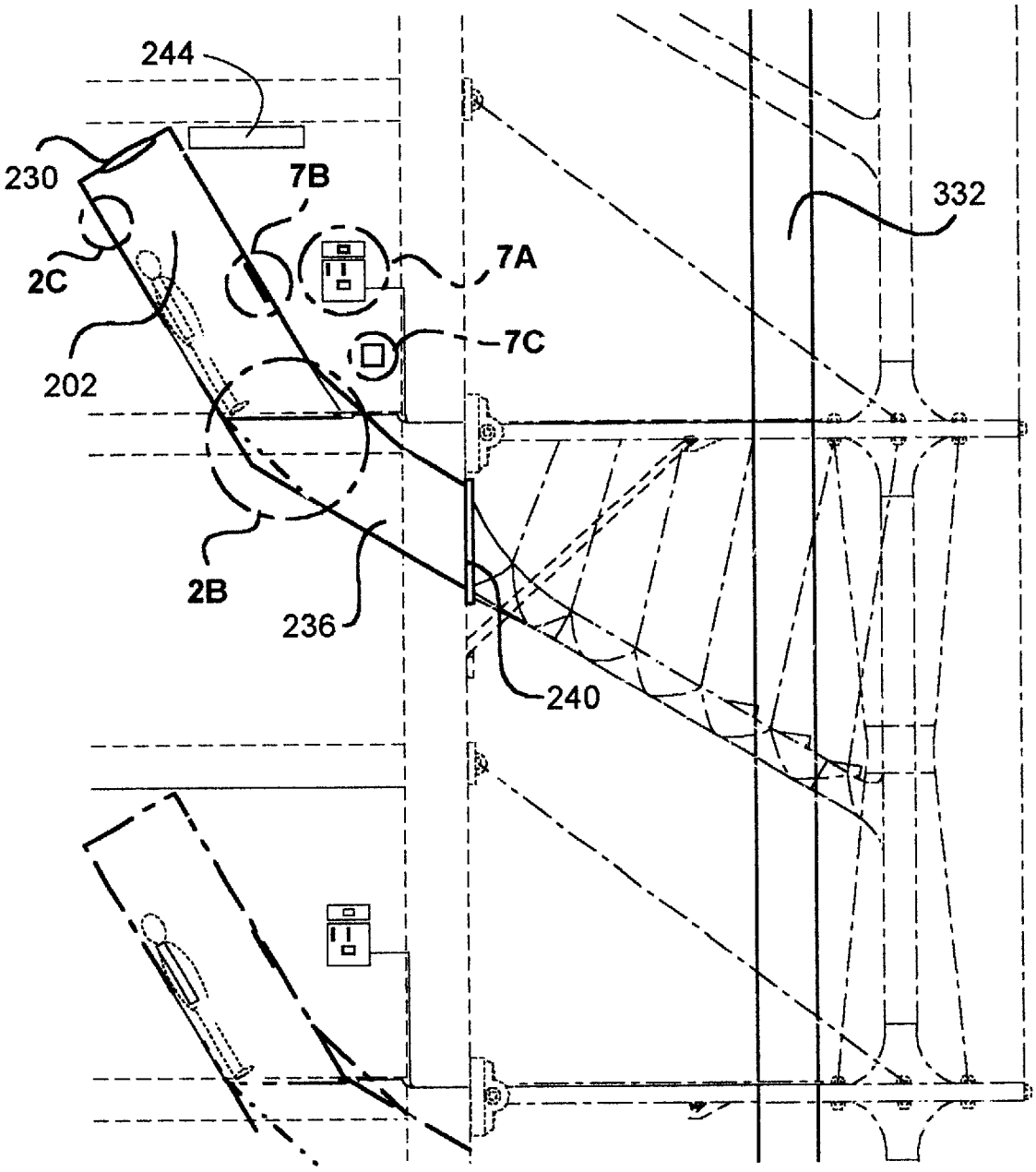
FIG. 2A shows a side, cut-away view of a building which focuses on egress booths in relation to the building.
Figure 2B:
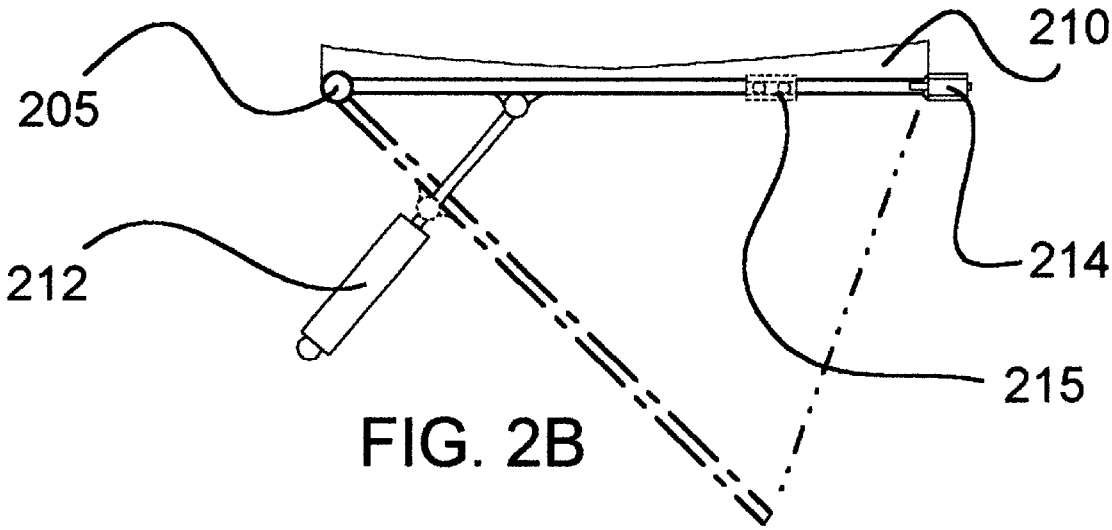
FIG. 2B shows a side view detail of a trap door for consistency with FIG. 2A.

The floor of the egress booth is a trap door 204 shown in FIGS. 2A and 2B, covered by a fabric sensor 210 that indicates whether the egress booth is occupied or not. The trap door leads to a passageway 236 that is slanted at about thirty to forty degrees. While the trap door 204 is open, a magnetic bolt latch 221 prevents the opening of the booth's cylindrical door 216.

The whole egress path, from the booth to the passageway, is lined with a coat of non-stick Teflon (™) 428. Shown in FIG. 2A, the passageway 236 leads out of the building through a somewhat circular aperture 238 with rounded edges and foam padding of about the same circumference as that of the egress booth, to prevent injury to evacuees. Outside the building, the aperture 238 is reinforced by an octagonal steel truss 240 that is bolted and welded onto the building's superstructure and serves as an attachment point for a diagonal section of a y-shaped modular descent tube 404 shown in detail by FIG. 4A. This diagonal section generally keeps the angle of descent set by the passageway 236.

As shown in FIG. 2A, the trap door 204 of the egress booth 202 and the whole passageway 236 is generally composed of very high tensile strength steel that is bolted and welded onto the building's superstructure to provide additional support for the octagonal steel truss 240, should the building walls be made out of glass instead of reinforced concrete or steel.

The interaction between active electronic components involving the previously mentioned magnetic bolt latch, door and occupancy sensors is summarized in FIGS. 10A and 10B.

IV. Modular Descent Tubes

A modular descent tube is either y-shaped 400 or cylindrical 402 as shown in FIG. 4B. The y-shaped modular descent tube 400, as shown in FIG. 4A, is functionally divided into diagonal 404 and vertical 406 sections. The cylindrical modular descent tube 402 shown in FIG. 4B, simply lacks the diagonal section 404 of the y-shaped modular descent tube 400. Both sections of the modular descent tubes are primarily composed of a continuous single piece cargo netting 408 shown in FIG. 4C, using ropes of advance materials employed in rock climbing and rescue helicopter long-lines as shown in. Netting made of Amsteel Blue (™) and Ultra-High Molecular Weight Poly Ethylene (UHMWPE) material, as manufactured by Samson Rope (www.samsonrope.com), are good examples.

With reference to the backbone netting shown in FIG. 4C, the vertical portion of the cargo netting 408 is compressed by about three-fourths of the average width of an adult person or less, while in the diagonal section of the cargo netting is compressed by about the average width of an adult person or less. The expansion of the modular descent tube is partially achieved by allowing horizontal segments of the cargo netting 460 to sag, as shown in FIG. 4D. The total length of this horizontal segments must be roughly equal to three compressed vertical segments of the cargo netting 462. This expansive potential will allow the main body of the cargo netting to span roughly three times its current width.

As shown in FIG. 4E, the compression difference between the vertical 406 and diagonal sections 404 of the modular descent tubes are maintained by enveloping the cargo netting 408 with a breathable elastic cladding 410 honeycombed with air holes 422, comprised of roughly seventy percent Lycra (™) and roughly thirty percent Cordura (™), both manufactured by DuPont (www.dupont.com).

Continuing with FIG. 4E, a breathable elastic lattice 412 nearly as thick as the cargo netting, composed of roughly the same ratio of Lycra (™) and Cordura (™) is then bonded to the breathable cladding 410 of the cargo netting. Thin vertical strips of UHMWPE material 413 are embedded or sewn into the breathable elastic lattice 412 and attached at the points where the cargo netting's 408 horizontal 460 and vertical segments 462 are joined, for added strength. As the modular descent tube expands, the Lycra (™) and Cordura (™) materials that are integrated in the breathable cladding for the cargo netting 410, together with the breathable elastic lattice 412 will return the main body of the cargo netting 408 to its original compressed state.

The only variation to the abovementioned elastic compression procedure is that the top, bottom and diagonal ends of each modular descent tube, whether y-shaped 400 or cylindrical 402, must be expanded to form a funnel 415 as seen in FIGS. 4C and 4F. The funnel is then affixed to trusses 320 or 240 that are affixed to the support poles 300 or the end of egress booth passageway 236 as shown in FIGS. 2A and 3B. The now expanded, funnel-shaped cargo netting 408 is reinforced and stabilized by a nearly identical funnel-shaped, fixed-tension UHMWPE netting 438 before being clad 410 in Lycra (™) and Cordura (™) as shown in FIG. 4C.

The rest of the processes involved in the breathable cladding of the cargo netting 408 and its integration with the breathable elastic lattice 412 does not differ from the previous paragraph. An additional breathable elastic support band 440, made of Lycra (™) and Cordura (™), is used at the end of each funnel as shown in FIG. 4A.

The near-maximum stretched width of the cargo netting 408 is about equal or somewhat less than the internal circumference of the egress booth 202. The normal, unstretched and uncompressed width of the cargo netting 408 after cladding is about equal to or somewhat greater than the average width of a large adult person. To prevent skin adhesion, a coating of non-stick substance such as PTFE or Teflon™ 428 is used on the breathable elastic lattice 412 as shown in FIG. 4E. This unique composition allows evacuees of varying physical builds a roughly regular rate of descent that is less than free-fall without compromising material strength and evacuee safety.

For reasons of safety, evacuees within the vertical section of the y-shaped modular descent tube 406 shown in FIG. 4J must not be able to grab onto the apertures in the diagonal section of the y-shaped modular descent tubes 404 as they travel downwards. This prevention is achieved by providing a reinforced opening in the vertical elastic lattice and cargo netting 432 that by allows an extra length of breathable elastic lattice from the diagonal section 430 clearly shown in FIG. 4I, to extend well within the vertical elastic lattice 424, and by completely covering this extra length 430, including the reinforced opening 432, with a cover flap 434 of elastic lattice material that is integrated with the vertical elastic lattice 424 such that it still offers a smooth surface to evacuees. An extra, internal Cordura (™) shield 436 is used in the portion of the vertical section of the descent tube at the junction immediately opposite the opening of the diagonal section. The areas where the breathable cladding of the cargo netting 410 separates from the breathable elastic lattice 412 is strengthened by reinforcement material 444 composed of additional Lycra (™) and Cordura (™) plus UHMWPE thread.

As shown in FIG. 4E, to protect evacuees against fire, the diagonal 404 and vertical 406 sections of the y-shaped modular descent tube are covered with a layer of fire-proof material 416, such as Nomex (™) manufactured by DuPont, that is folded in a z-patten, to provide a a thicker shield against fire. The base of the z-pattern folds 418 has a layer of Lycra (™) and Cordura (™) that bonds with the breathable cladding for the cargo netting 410. The z-pattern folds 418 allow simultaneous expansion to roughly three times its current length, approximating the cargo netting's 408 elastic tolerances.

The outer skin of fire-proof material 416 does not afford ventilation unlike the cargo netting 408 and the breathable elastic lattice 412. Thus, the fire-proof material in the vertical section of the y-shaped modular descent tube 406 or the cylindrical modular descent tube 402 has large and regular vertical ventilation openings 448 shown in FIG. 4B, that are positioned away from the building. For the diagonal section of the y-shaped modular descent tube 404, the portion which is farthest away from the building has several Nomex (™) shielded ventilation openings 450 that ensure appropriate ventilation without risking direct exposure to fire as shown in FIG. 4A.

The ends of each modular descent tube's fire-proof material 416 are joined together, reinforced and attached to a five-bar truss 321 as shown in FIG. 4H.

V. Sensors and Switches

As shown in FIG. 4K, the modular descent tubes are equipped with fabric sensors 414 similar to the ones manufactured by SoftSwitch Ltd. Company in the United Kingdom (www.softswitch.co.uk). These fabric sensors are embedded between the cargo netting 408 and breathable elastic lattice 412 as shown in FIG. 4E. These sensors ensure that the egress booth trap door 204 will only open if a predetermined length of space in the descent tubes is free of evacuees. This length of space is projected to be available and thus reserved for the evacuee in the egress booth by the time the said evacuee crosses the diagonal section of the y-shaped modular descent tube 404.

As shown in FIGS. 4E and 4L, the diagonal length of the y-shaped descent tube is equipped to actively monitor its integrity or continuity by embedding multi-mode fiber optic cables 454 like those manufactured by Lucent (www.lucent.com) in the z-folds of the fire-proof material used in the descent tube. If the light from this continuity assurance fiber-optic cable is not received by the fiber-optic transceivers 700, the egress booth trap door 204 will not open. Similarly, also shown in FIG. 4L, the whole vertical length of either y-shaped 400 or cylindrical 402 modular descent tube from the top of the building to the ground is equipped with single-mode fiber-optic cables 452 for integrity or continuity monitoring. Again, all egress booth trap doors 204 attached to a particular descent tube will not open if damage to vertical continuity is detected.

A vertical continuity override button 234 is available to authorized personnel should vertical continuity damage be determined to be restricted to higher floors while the rest of the system to the ground is still intact as shown in detail in FIG. 7C and located through FIG. 2A.

All fiber-optic cables used are generally the light-weight, supple indoor-type, partially reinforced with Kevlar (™) and clad with nontoxic material. All collision and continuity cables are deployed via a special wave form cable path 420 composed of Lycra (™) in the outer z-pattern fold of the fire-proof material 416, as shown in FIGS. 4E and 4M. The wave form cable path 420 reduces the chance for expansive breakage and reduces cable slippage. The wave form path is comprised of elastic Lycra (™) lining also allows the fiber-optic cables to take up reserved slack 455 located in each truss area, also to prevent breakage as shown in FIG. 4H. All diagonal continuity verification multi-mode fiber-optic cables 454 and anti-collision fabric sensor cables 456 reach the building through internally insulated pipes 346 attached to the support poles 300 as shown in FIGS. 3A and 3B.

The interaction between active electronic components involving the previously mentioned fabric sensors, transceivers, overrides and fiber-optic cables is summarized in FIGS. 10A and 10B.

VI. Truss Design and Strategies for Volume

Both elliptically-shaped truss 240 for the diagonal section of the y-shaped modular descent tube 404 and the octagonally-shaped trusses on the support poles 300 shown in FIGS. 2A and 3B serve the same primary purpose of providing attachment point for the wrapping of reinforced edges 442 of either the y-shaped 400 or the cylindrical 402 modular descent tubes. These trusses are composed of very high tensile strength steel that are forged as a single finished unit. As shown in FIG. 4G, each single side of the octagon is branches into five metal bars 321 so as not to significantly diminish thickness or strength, as shown in FIG. 3C. The support poles similarly have forged bends 324 as shown in FIG. 3B so as not to obstruct these metal bars.

As shown in FIG. 4H, two of the bars on the top half support the bottom end of a higher modular descent tube and the other two bars on the bottom half supports the top end of the next modular descent tube, thus allowing separate modular descent tubes to be connected as a single functional unit. The two outer bars are for the attachment of the breathable elastic material's reinforced edges 442 and the two inner bars are for the attachment of the cargo netting's reinforced edges 443. Clamps and fastening bolts 326 are used for the breathable elastic material while rock climbing rope locks 512 are used on the cargo netting's reinforced edges 443 and complementary fixed-tension UHMWPE netting 438 to create the funnel 415 of each modular descent tube.

As shown in FIG. 4B, the bottom of each modular descent tube has an extra length of breathable elastic lattice tail 446 that extends well within the modular descent tube immediately below it and provides a guided transition for the evacuees as they move from one modular descent tube to another. Foam padding 445 is used around the elastic lattice tail 446 as an additional safety measure.

Both y-shaded 400 and cylindrical 402 modular descent tubes are provided for every other floor of the building, as shown in FIG. 4B. Although other combinations are possible, depending on a building's exact design. This alternating descent tube strategy will allow for greater spacing between evacuees, thereby increasing the supported volume of evacuees without increasing the risk of collisions and installation costs.

As a primary protection against fire, all support poles 300 have an arched attachment bar 330 shown in FIG. 3B, located between the building and the trusses for the deployment of a continuous vertical fire-proof material shield 332 as shown in FIG. 2A that serves as the evacuees first defense against flame while within the vertical descent tubes. This primary fire-shield 332 is specially important when the design of the building requires that support poles be positioned to gently slope away from a lower roof Naturally this fire-shield 332 has openings for each diagonal section of the y-shaded modular descent tube 404.

VII. Stabilizer Webbings and Supports

As shown in FIG. 3B, between each pair of square/octagonal steel trusses are horizontal bars 336 and support arches 334 for torsion resistance. The support poles 300 have several regularly spaced webbing cable anchor points 340.

As shown in FIG. 5A, the bottom of the diagonal section of the y-shaded modular descent tube 404 is supported from excessive sagging by a series of diamond-shaped Cordura (™) and UHMWPE material 502 covered by fire-proof material such as Nomex (™). In hammock fashion, the skyward-facing points of that diamond-shaped material serve as the attachment point for webbing ropes 500 made of advanced materials used in rock climbing or rescue helicopter long line cables, similar to that manufactured by Samson Rope (www.samsonrope.com). Each rope is covered with fire-proof cladding material similar to that used for the descent tube's outer cover.

Likewise depicted in FIG. 5A, the approximate center of each modular descent tubes is stabilized from excessive swaying by a Nomex (™) covered Cordura (™) and UHMWPE ring 506 lined with foam, which provides attachment points for the same webbing ropes 500 mentioned earlier. The webbing ropes are affixed to the support pole anchor points 340. This stabilizer system is important when the spacing of support poles 300 span several floors.

VII. Inflatable Slide and Test Dummy

The very last support pole nearest to the ground 352 shown in FIG. 6A, located about three or four stories high, is equipped with an inflatable slide 600 similar to that manufactured by Carlton Technologies (www.carltech.com) that is held by a protective cover 614. As this last support pole reaches horizontal, the pole's horizontal sensor switch 310 simultaneously releases the protective cover magnetic bolt latch 804 and activates the air cylinders with aspirators 612. The slide quickly unfolds and inflates. The slide's thick padded base contains surface reinforcements 602 and has high side walls and cover netting 604 shown in FIG. 6B, that create a separate channel or path 622 for each modular descent tube. Slide support webbings 606 originating from the last support pole 352 shown in FIG. 6A is used to ensure that the slide does not sag prematurely due to its length. Towards the end of the slide at ground level, both sides of the slide have a flat padded area to serve as an evacuee receiving area 608. The very far end of the slide has a cushioned catch wall 610. Redundant electronic air pressure sensors and mated electronic switches 616, similar to that manufactured by Keyence America (www.keyence.com) or Entran (www.entran.com), are embedded within the slide to reach a predetermined threshold that indicates that the slide is sufficiently inflated.

As shown in FIGS. 4L and 6A, the mated electronic switches of the slide's air pressure sensors then activate around four to eight fiber optic transceivers its mated electronic switches 700 similar to the ones manufactured by Lucent (www.lucent.com) that light up the single-mode fiber optic cables 452 that run to the top of the building and down again, embedded vertically in the modular descent tubes. If the light returns to the other transceiver, the mated electronic switch of the fiber optic transceiver sends a signal to all egress booth trap door control relays 704 indicating that vertical continuity is intact. Should damage to the single-mode fiber-optic cables 452 occur, the vertical continuity good signal will not be sent and the egress booth trap door 204 will not open unless the vertical continuity override button 234 or the trap door manual override lever 232 would be engaged, shown in FIG. 7C.

The interaction between all these active components involving the previously mentioned air pressure sensors, fiber-optic transceivers, magnetic bolt latches and override buttons are summarized in FIGS. 10A and 10B.

For security reasons, the last set of support poles nearest to the ground may be intentionally designed not to support diagonal descent and thus take the form of a simple cylindrical modular descent tubes 402 as shown in FIG. 4B.

It is very important to emphasize that the intended emergency evacuation receiving area for the inflatable slide must be kept clear of cars and other obstructions at all times.

A dry run of the modular descent tubes is optional, considering all the safety sensors employed. If required, a test dummy 618 shown in FIG. 6B with passive keyed bands of conductive material 619 on both front and back surfaces can be provided to take the first trip down the just-deployed system. As soon as all poles have reached horizontal and the slide has sufficiently inflated, the topmost pole receives a 'vertical continuity ok' signal that triggers the activation of a magnetic bolt latch 804 that frees the test dummy's suspension loop 624, and the test dummy begins its descent. The test dummy is generally made of soft rubber and shaped to approximate a prone human form, but is contoured to be faster than a human in its descent so as not to waste valuable time. It has a flexible midsection, so as to facilitate passage from the diagonal section 404 to the vertical section 406 of the y-shaded modular descent tube. It is also of similar weight as that of a real person of the same height. The test dummy does not need to contain any active sensors, rather it has passive keyed bands of conductive material on both of its surfaces. Once the test dummy reaches matching active keyed bands of conductive material 620 found on each slide channel surface towards the end of the inflatable slide, as shown in FIG. 6D, even if only momentarily, it completes a circuit that sends a signal through copper signaling cable 702 that ultimately reaches all egress trap door control relays 704 assigned to that particular tube, that indicates that the test dummy has successfully completed its descent.

The interaction between active electronic components involving the previously mentioned test run signal, magnetic bolt latches and pole horizontal switch is summarized in FIGS. 10A and 10B.

IX. Control Signals

The following description in the succeeding paragraphs relates to FIGS. 10A and 10B. Each major component of the present invention has embedded sensors that belie its simplicity with regard to its application in the present invention. Even air pressure sensors 616 embedded in the inflatable slide 600 are pre-calibrated, thus all sensors indicated in this document are mated to, or function as, simple off-in electronic switches, which makes it a simple matter for those knowledgeable in the art to implement. For example, if light from the fiber-optic cable 452 within the cylindrical modular descent tubes 402 is received by the fiber-optic transceiver 700, the vertical continuity 'on' signal is sent through copper cabling for trap door control signals 702 running inside and up the building to each egress booth's wiring box 705.

For obvious safety reasons, the egress booth trap door 204 must only open if the following conditions have been met: the system activation button 200 has been pressed, all support poles 300 have reached horizontal position, the test dummy 618 successfully reached the end of the slide, diagonal section 404 continuity is verified, fabric sensor 414 space-reservation in the modular descent tube is okay, vertical continuity 402 and 406 is verified, the egress booth occupancy sensor 210 is positive, the egress booth cylindrical door is closed 218 and finally, the trap door release button 206 or the auxiliary trap door release button 208 is pressed. These nine safety conditions are given physical representation by the respective sensors and mated switches to signals for nine simple, low-voltage electrical relays 704 located at each egress booth wiring box 705. Each of these nine low-voltage electrical relays must all be in the 'on' position to complete a circuit that activates the opening of the egress booth trap door's magnetic bolt latch 214.

There are two sets of signal and power wiring. The first set involves wiring and uninterruptible power for system signals that must run up and down the whole height of the building. Specifically these signals affect all egress booths that are related through its attachment to a single modular descent tube. These four signals are: a) General System Deployment b) Test Dummy Descent Complete, c) All-Poles are Horizontal and d) Vertical Continuity Okay (Slide Air-Pressure Sensors and Vertical Fiber-optic Cable). The wiring and power for these signals originate in the area within the building directly adjacent to the last support pole 352 that houses the inflatable slide 600.

The second set concerns wiring and UPS power for system signals that are considered 'local' to each egress booth on a particular floor. Specifically, these signals do not affect other egress booths on other floors. These five signals are: a) Diagonal Continuity Good c) Space-Reservation Okay d) Occupancy Positive e) Door is Closed and f) Trap Door Release Button Pressed (Auxiliary and Main).

Figure 2C:
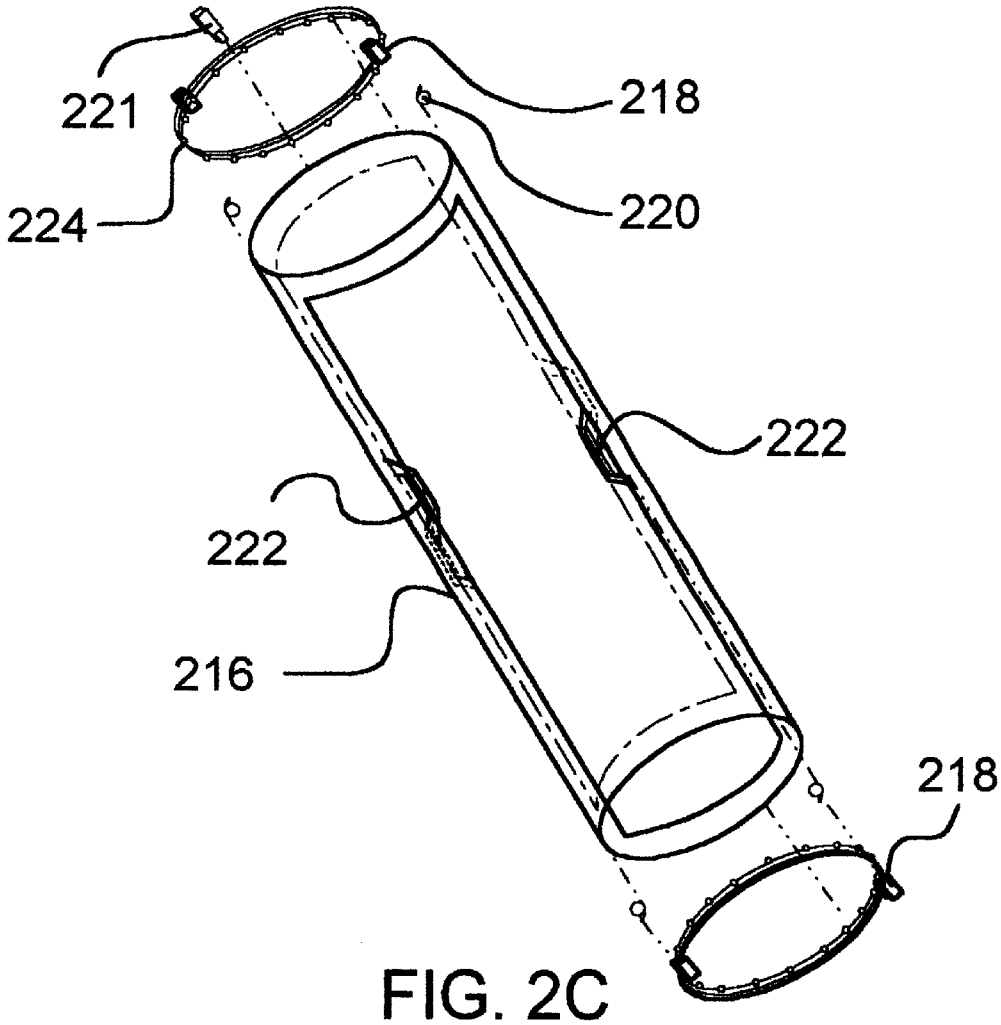
FIG. 2C shows an exploded view of an internal cylindrical door for the egress booth.

As shown in FIGS. 2A to 2C, after the egress booth trap door magnetic bolt latch 214 is opened, as a result of all nine low-voltage electrical relays 704 being activated, a trap door hinge 205 takes the weight of the trap door 204 as it swings open and the evacuee descends. The booth's cylindrical door 216 is simultaneously locked via a magnetic bolt latch 221 with the opening of the trap door, and stays locked until the trap door closes, as detected by a trap door sensor 215. The egress booth trap door automatically closes with the help of a calibrated damper rod 212 similar to that manufactured by Stabilus of Germany (www.stabilus.com) after the evacuee's weight is off the trap door 204.

As previously mentioned, the egress booth trap door 204 can also be opened by engaging the trap door manual override lever 232 shown in FIG. 7C. The egress booth trap door 204 cannot be opened from the passageway 236 as the trap door magnetic bolt latches 214 are embedded in reinforced concrete and the building's superstructure. Likewise security is not compromised since the aesthetic and protective covers 800 or 802 for the apparatus are normally locked shut.

A required signage immediately above the egress booth 244 announces its status and availability as follows: Emergency Exit: Available (Green), Occupied (Yellow), Damaged: Use other Exits! (Red).

System deactivation after a general building evacuation must only be done by authorized personnel. It is accomplished by disabling the System Activation 200 signal wire to all egress booth wiring boxes 705. This is provided as a key switch 709 at secret, customized locations for obvious reasons.

ALTERNATIVE EMBODIMENTS

With regard to the egress booth, an alternative embodiment for more disciplined, somewhat military use is to forego the egress booth, trapdoor and inflatable slide altogether. An aperture in the wall immediately leads out to the diagonal section of a y-shaded modular decent tube. A steel bar immediately above the aperture allows the evacuee to lift his or her whole body into the passageway, as shown in FIG. 9A. The evacuee should only let go of the bar when the anti-collision fabric sensors light up a green bulb that indicates that the evacuee can safely proceed.

Another embodiment simply removes the egress booth but retains the trap door as shown in FIG. 9C. Using a floor-based aperture, the trapdoor is repositioned at the very end of the passageway. This can be particularly usefull since unconscious individuals can be supported upright with relative ease.

These two previous alternative embodiments that forego the egress booth will reduce the amount of real estate needed by the system within the building to nearly nothing. For obvious reasons both alternative embodiments require specially-built aperture covers.

Another alternative embodiment relates to the support poles. If it becomes necessary to have evacuees travel somewhat diagonally at an angle where octagonal trusses would not be required, special support poles, webbings and descent tubes can be deployed as shown in FIG. 9B. The advantage of this embodiment is that the evacuee can expeditiously transfer to another side of a building. Closer to the ground, this embodiment allows for greater flexibility with regard to the choice of evacuee receiving area.

Moreover, an alternative embodiment for the support poles relates to a rerouting feature that is impossible to implement using ordinary elevators. If for some reason, the regular exit inflatable slide location or the existing vertical path or building side is not desirable, a customized, heavier duty support pole will be equipped with a special two-part truss. The top portion can slide into position over a bottom truss that supports four descent tubes, as shown in FIG. 9D. If no one is in both modular descent tubes, as verified by the anticollision fabric sensors, the top truss be used to redirect evacuees from the usual descent tube to a new exit location provided by the alternate descent tubes.

OPERATION—PREFERRED EMBODIMENT

During a major building emergency such as fire, earthquake or a terrorist incident, any building occupant may press the system activation button 200 after breaking its transparent cover. The evacuee waits while the system initializes. The egress booth status signage 244 signals that it is available. The evacuee steps inside the egress booth 202 and due to its slanted position, induces the evacuee to lean and to assume a position appropriate for egress. The evacuee presses the internal trapdoor release button 206. The evacuee then sees a signage 246 that says 'Please close booth door' if it is still open. Once the door is closed, the space-reservation fabric sensor 414 ensures that a length of space in the vertical descent tube is free of other evacuees. For safety reasons, the booth's 202 cylindrical door 216 must first lock into place immediately prior to opening the trap door 204. Once the cylindrical door lock is established, the fabric sensor then activates the last low-voltage electrical relay 704 required to release the trap door magnetic bolt latch 214. The trap door opens and the evacuee, by force of gravity and with a bit of help from the Teflon coating 428 will slide downwards to the passageway 236 and out of the building.

In the diagonal section of the modular descent tube 404 the evacuee's descent is somewhat rapid as the diagonal breathable elastic lattice 426 is not as narrow as it is in the vertical section of the modular descent tube 406. As the evacuee's body stretches the modular descent tube's material, the evacuee's rate of descent is reduced to less than free fall speed. However, the breathable elastic lattice 424 or 426 is designed to be soft and supple enough to allow evacuees of varying physical builds, a roughly regular rate of descent. The evacuee then reaches the end of the modular descent tube and is transported to the receiving area 608 at the end of the inflatable slide 600, where the evacuee is assisted by rescue personnel.

As previously mentioned, parents should wear provided infant harnesses when carrying infants through the system. A small child can be embraced by the parent as they simultaneously travel down the modular descent tube. Small children or infants should never be allowed to travel down the modular descent tube without an adult. Unconscious individuals can be accompanied by an adult.

CONCLUSION, RAMIFICATIONS AND SCOPE

Accordingly the reader will see that the present invention provides a viable, effective and safe high-rise emergency mass evacuation apparatus that is a real-world solution to a long felt and long existing need.

In this post Sep. 11, 2001 era, each comer of every high-rise building should have an implementation of the present invention as a standard emergency evacuation device, depending upon the average total number of building occupants that must be evacuated within a desired number of minutes.

Various stick-on signs affixed near the egress booth are strongly recommended to guide the evacuees in the proper use of the system. One example of an informational signage indicates that high-heeled shoes must be removed or that shoe covers for high-heeled shoes that must be worn before entering the egress booth. Another example is a signage that strongly recommends that all infants and small children be carried in harnesses strapped to an adults. Finally, another signage example directs evacuees or rescue personnel to use specially designed self-inflating stretchers with restraints for unconscious individuals.

If at all feasible, it is also recommended that a closet with a transparent cover be positioned near each egress booth. Inside the closet are the previously mentioned infant harnesses, shoe covers, and self inflating stretchers.

Finally, despite the intuitive, user-friendly nature of the apparatus, building administrators should educate all new tenants in the proper use of the emergency evacuation apparatus. There is no doubt that this orientation can only boost the tenant's confidence in their safety and provide peace of mind.

While the above description contains many specificities, these should not be construed as limitations on the scope of the invention, but rather as an exemplification of one preferred embodiment thereof. Accordingly, the scope of the invention should be determined not by the embodiments illustrated, but by the appended claims and their legal equivalents.

I claim:

1. An externally conceable, modular high-rise emergency evacuation apparatus with pre-qualified egress comprising:

(a) a plurality of egress booths, each obliquely angled and equipped with a cylindrical door, having sufficient size to accommodate an adult in excess of six feet in height or an adult with an infant or child, generally positioned at vertically equidistant, predetermined locations, (b) a trap door affixed to the bottom of each said egress booth, (c) a passageway affixed to said trap door, slanted to approximate the oblique angle of said egress booth, (d) an elliptical truss affixed to the end of said passageway, adapted to be secured to an aperture in the side of the building, (e) a plurality of support poles, (f) a plurality of pole bracing means for mounting and lowering said support poles from vertical to horizontal positions, adapted to be secured to the building at predetermined locations, (g) a plurality of generally octagonal trusses affixed substantially near the ends of said support poles, (h) a plurality of descent tubes formed from elastic material is y-shaped where a diagonal section approximates the oblique angle of said passageway, covered with a fire-proof material, viscerally coated with a non-stick substance, reinforced generally by an embedded single piece cargo netting, and affixed to above-mentioned elliptical and octagonal trusses, (i) a plurality of web stabilizing means for supporting said descent tubes, affixed to said support poles, (j) an inflatable slide equipped with air pressure sensors, affixed to a last support pole nearest to the ground, (k) a protective and aesthetic covering means for concealing and revealing the external components of said evacuation apparatus, and (l) an active monitoring, coordinating an controlling means for deploying said evacuation apparatus and pre-qualifying conditions required for implementing safe evacuee egress, comprising:

(1) a complete escape path integrity sensing means for constantly monitoring the wholeness of said descent tubes and said inflatable slide, including verification that said support poles are in a properly deployed position, for keeping said trap doors closed should damage be detected, (2) a collision avoidance sensing means for timing the opening of said trap doors at an opportune moment when collision between evacuees in diagonal and vertical descent is estimated to be avoided, (3) an access regulating means for preventing said cylindrical doors of said egress booths form being opened immediately after evacuees exit, while said trap doors have not yet returned to a closed position, (4) an optional initial descent validating means for verifying the arrival of a test dummy on each said inflatable slide, after passing through the whole vertical length of said evacuation apparatus, prior to activating said trap doors assigned to said inflatable slide, (5) an egress controlling means for pre-qualifying compliance to signals to open said trap doors, by validating if said egress booths are occupied and checking if said cylindrical doors are closed, applied in conjunction with all previously mentioned active monitoring, coordinating and controlling means, and (6) an overall system regulating means for orchestrating the interaction between all aforementioned means and components of said evacuation apparatus, to establish proper deployment, autonomous operation and orderly shutdown, including overriding predetermined safety features if deemed necessary by authorized personnel, whereby said evacuation apparatus seeks to address the root cause of truly unnecessary and avoidable multiple fatalities that are suffered when people in burning high-rise buildings who are still conscious and mobile, have become totally cut-off from rescue, specially above or at the level of the fire, by empowering all evacuees with a safe, rapidly available, swift yet coordinated, direct, non-strenuous and verifiably complete escape path, a critical combination of features which are not provided by emergency stairwells or elevators.

2. A method of enabling people, including the injured, the elderly, or disabled persons to escape entrapment from or to bypass the levels of a high-rise building that is impassable due to flame, smoke or heavy damage, safely with very little effort or assistance, comprising:

(a) giving evacuees simple, intuitive steps for implementing egress, comprising:

(1) stepping inside an obliquely angled egress booth, (2) closing a cylindrical door of said egress booth, and (3) pressing a button to activate a trap door at the bottom of said egress booth, (b) pre-qualifying egress safety conditions, before permitting evacuees to exit, comprising:

(1) providing a complete escape path integrity sensing means which will actively monitor the wholeness of a plurality of generally y-shaped descent tubes and an inflatable slide, including verification that a plurality of support poles are in properly deployed position, for keeping said trap doors closed should damage be detected, (2) providing a collision avoidance sensing means which will time the opening of said trap doors at an opportune moment when collision between evacuees in diagonal and vertical descent is estimated to be avoided, (3) providing an access regulating means which will prevent said cylindrical doors of said egress booths from being opened while said trap doors have not yet returned to a closed position, immediately after evacuees exit, (4) providing an optional initial descent validating means which will verify the arrival of a test dummy onto said unflatable slide, after passing through all vertical sections of said descent tubes, prior to activating said trap doors assigned to said inflatable slide, and (5) providing an egress controlling means which will pre-qualify compliance to signals to open said trap doors, by validating if said egress booths are occupied and checking if said cylindrical doors are closed, applied in conjunction with all aforementioned egress safety means, (c) transporting evacuees after all previously mentioned egress safety conditions have been met, further employing additional safety features, comprising:

(1) covering a complete path used for descent with non-stick lining at predetermined locations, so as not to cause harmful abrasion to exposed skin, (2) opening said trap doors at a predetermined instance that complies with all previously mentioned egress safety conditions, causing evacuees to slide through passageways beneath said trap doors then through diagonal sections of said descent tubes, wherein said passageways and said diagonal sections approximate the oblique angle of said egress booths to facilitate the sliding motion, (3) transitioning evacuees thereafter to vertical sections of said descent tubes, where the rate of descent of the evacuees are slowed down appreciably to less than free-fall speed due to the expansion of the elastic components of said descent tubes, (4) protecting evacuees in diagonal and vertical descent against flame by covering said descent tubes with a fire-proof material, generally corrugated so as not to hamper the required elastic properties of said descent tubes, (5) distancing evacuees considerably away from fire and smoke by locating the vertical sections of said descent tubes substantially near the extremities of said support poles, (6) supporting the weight of multiple evacuees safely, by complementing each said descent tube generally with a single piece cargo netting interlaced with a breathable cladding of elastic material so as not to sacrifice required elastic properties, (7) supplying evacuees with sufficient ventilation, by utilizing a breathable elastic lattice that is affixed to predetermined vixceral areas of said cargo netting, and by furnishing said fire-proof material with openings at carefully predetermined locations, and (8) providing slide means equipped with self-integrity monitoring, which enables multiple evacuees to either disembark swiftly in an orderly fashion, or be simultaneously fetched and assisted by emergency personnel, (d) providing an overall system regulating means which will orchestrate the interaction between all aforementioned means and components used in said method, to establish proper deployment, autonomous operation and orderly shutdown, including overriding predetermined safety features if deemed necessary by authorized personnel, whereby said method overcomes the limitations of an elevator system, by safely enabling evacuees to randomly egress from different vertical locations of said high-rise building in a continuously streaming fashion, while requiring a comparatively minimal amount of power for proper deployment and autonomous operation,.

whereby said method overcomes the inordinate amount of time, excessive physical exertion and prolonged mental concentration demanded from evacuees using an emergency stairwell, by enabling all evacuees, regardless of physique or health condition, to be directly transported to safety with approximately equal speed and efficiency, and whereby said method seeks to address the root cause of truly unnecessary and avoidable multiple fatallities that are suffered when people in burning high-rise buildings who are still conscious and mobile have become totally cut-off from rescue, specially above or at the level of the fire, by empowering all evacuees with a save, rapidly available, swift yet coordinated, direct, non-strenuous and verfiably complete escape path, a critical combination of features which are not provided by emergency stairwells or elevators.

* * * * *